US009827687B2

(12) United States Patent
Kawaguchi et al.

(10) Patent No.: US 9,827,687 B2
(45) Date of Patent: Nov. 28, 2017

(54) CUTTING APPARATUS AND CUTTING CONTROL PROGRAM THEREFOR

(71) Applicant: BROTHER KOGYO KABUSHIKI KAISHA, Nagoya-shi, Aichhi-ken (JP)

(72) Inventors: Yasuhiko Kawaguchi, Nagoya (JP); Yoshinori Nakamura, Toyohashi (JP); Masahiko Nagai, Nagoya (JP); Tomoyasu Niizeki, Ichinomiya (JP); Katsuhisa Hasegawa, Kasugai (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 121 days.

(21) Appl. No.: 14/754,021

(22) Filed: Jun. 29, 2015

(65) Prior Publication Data

US 2015/0298334 A1 Oct. 22, 2015

Related U.S. Application Data

(62) Division of application No. 13/421,950, filed on Mar. 16, 2012, now abandoned.

(30) Foreign Application Priority Data

Mar. 30, 2011 (JP) ..... 2011-075577
Mar. 30, 2011 (JP) ..... 2011-075579

(51) Int. Cl.
*B26D 5/00* (2006.01)
*B26D 7/02* (2006.01)
(Continued)

(52) U.S. Cl.
CPC ..... *B26D 5/005* (2013.01); *B26D 7/025* (2013.01); *B26D 7/04* (2013.01); *B26F 1/3813* (2013.01);
(Continued)

(58) Field of Classification Search
CPC ..... B26D 5/00; B26D 5/005; B26D 7/025; B26D 7/04; B26F 1/3813; Y10T 83/5669; Y10T 83/7573
See application file for complete search history.

(56) References Cited

U.S. PATENT DOCUMENTS 5,468,081 A 11/1995 Cane et al.
6,544,819 B2 4/2003 Odajima et al.
(Continued)

FOREIGN PATENT DOCUMENTS

JP 05309596 A * 11/1993
JP 7-251599 A 10/1995
JP 2005-205541 A 8/2005

*Primary Examiner* — Stephen Choi
(74) *Attorney, Agent, or Firm* — K&L Gates LLP

(57) ABSTRACT

A cutting apparatus includes a holding member disposed at a position opposed to a cutting blade and having an adhesive layer removably holding an object, a pressing unit pressing the object held by the holding member and having a contact portion brought into contact with the object, a region specifying unit specifying a region where an adhesive retention of the adhesive layer is insufficient along a cutting line of the object cut by the blade, and a control unit controlling the pressing unit so that when the object is cut by moving the blade and the holding member holding the object relative to each other, at least either an amount of pressing or a pressing force of the contact portion is changed between a case where the region specified by the region specifying unit is cut and a case where any part other than the specified region is cut.

2 Claims, 16 Drawing Sheets

(51) Int. Cl.
*B26D 7/04* (2006.01)
*B26F 1/38* (2006.01)

(52) U.S. Cl.
CPC ..... *B26D 5/00* (2013.01); *Y10T 83/5669* (2015.04); *Y10T 83/7573* (2015.04)

(56) References Cited

U.S. PATENT DOCUMENTS

| | | | | |
|---|---|---|---|---|
| 2004/0094003 | A1 | 5/2004 | Bar-Erez | |
| 2005/0051011 | A1* | 3/2005 | Onishi ..... | B26D 1/035 83/428 |
| 2005/0186010 | A1 | 8/2005 | Shibata et al. | |
| 2006/0000338 | A1 | 1/2006 | Rankin et al. | |
| 2006/0200267 | A1 | 9/2006 | Aamodt et al. | |
| 2010/0278579 | A1 | 11/2010 | Ohashi | |

* cited by examiner

CUTTING APPARATUS AND CUTTING CONTROL PROGRAM THEREFOR

CROSS-REFERENCE TO RELATED APPLICATIONS

This application is a divisional of U.S. patent application Ser. No. 13/421,950, filed on Mar. 16, 2012, which is based upon and claims the benefit of priority from the prior Japanese Patent Application Nos. 2011-075577 and 2011-075579 both filed on Mar. 30, 2011, the entire contents of which are incorporated herein by reference.

BACKGROUND

1. Technical Field

The present disclosure relates to a cutting apparatus in which a cutting blade and an object to be cut are moved relative to each other so that the object is cut by the cutting blade and a storage medium which is computer-readable and stores a control program on which the object is cut into a desirable shape.

2. Related Art

There has conventionally been known a cutting plotter which automatically cuts a sheet-like object to be cut, such as paper or resin sheet. The cutting plotter includes a drive mechanism having rollers which hold the object from the vertical direction so that the object is moved in a first direction. The drive mechanism also includes a carriage having a cutting blade which is moved in a second direction perpendicular to the first direction, whereby the object is cut.

FIG. 17 schematically illustrates an ordinary cutter (a cutting blade) 100 and a cutter holder 101 both provided in the conventional cutting plotter. As shown, the cutter 100 is fixed to a lower end of a bar-like cutter mount 102 by a screw 103. The cutter mount 102 is supported by a bearing 104 attached to a recess 101*a* formed in the lower end of the cutter holder 101, whereby the cutter mount 102 is rotatable about an axis line O. Furthermore, the cutter 100 has a blade edge 100*a* which is offset by a predetermined distance d relative to the axis line O. Accordingly, when the cutter 100 and a sheet 105 are moved relative to each other so that the sheet 105 is cut by the cutter 100, the blade edge 100*a* of the cutter 100 is subjected to a resistive force (reactive force) from the sheet 105 such that the cutter mount 102 is rotated about the axis line O. More specifically, the direction of the blade edge 100*a* of the cutter 100 is automatically changed according to a moving direction in which the cutter 100 and the sheet 105 are moved relative to each other.

Additionally, one of the above-described type cutting plotters is provided in which a sheet such as paper is pressed from upward by a biasing plate thereby to be prevented from floating. In this cutting plotter, the sheet around the cutter can be pressed by the aforementioned biasing plate so as not to float. However, when a part of desired shape has been cut out of the sheet, a driving force of the drive mechanism is not transferred to the cut-out portion of the sheet. Accordingly, the sheet cannot be moved correctly.

In view of the above-described problem, an improved cutting plotter is proposed in which a sheet such as paper is affixed to a sheet-like member (corresponding to a holding member) having an adhesive layer on a surface thereof. In this case, the sheet can strongly be held when the adhesion of the adhesive layer is increased. However, it becomes difficult to remove the sheet from the sheet-like member when the adhesion of the adhesive layer is increased. On the other hand, when the adhesion of the adhesive layer is reduced, the sheet cannot strongly be supported although the sheet can easily be removed from sheet-like member. In this case, there is a possibility that the sheet would be displaced relative to the sheet-like member such that the sheet could not be cut accurately. More specifically, the conventional cutting plotters having strong and weak adhesions have respective defects, both of which defects have been desired to be improved.

SUMMARY

Therefore, an object of the disclosure is to provide a cutting apparatus in which the object can reliably be held by the holding member and can accurately be cut and the object can easily be removed from the holding member.

The present disclosure provides a cutting apparatus in which a cutting blade and an object to be cut are moved relative to each other based on cutting data, so that the object is cut by the cutting blade. The cutting apparatus includes a holding member which is disposed at a position opposed to the cutting blade and has an adhesive layer removably holding the object; a pressing unit which presses the object held by the holding member, the pressing unit having a contact portion brought into contact with the object; a region specifying unit which specifies a region where an adhesive retention of the adhesive layer is insufficient along a cutting line of the object cut by the cutting blade based on the cutting data; and a control unit which controls the pressing unit so that when the object is cut by moving the cutting blade and the holding member holding the object relative to each other, at least either an amount of pressing or a pressing force of the contact portion against the object is changed between a case where the region specified by the region specifying unit is cut and a case where any part of the object other than the specified region is cut.

The disclosure also provides a medium which is non-transitory and computer-readable and stores a program that is incorporated in a cutting apparatus including a holding member which is disposed at a position opposed to a cutting blade and has an adhesive layer removably holding an object to be cut and a pressing unit which presses the object held by the holding member and has a contact portion contacting the object. The object is cut by the cutting blade by moving the cutting blade and the holding member holding the object relative to each other. The program causes a control device of the cutting apparatus to execute instructions comprising specifying a region where an adhesive retention of the adhesive layer is insufficient along a cutting line of the object cut by the cutting blade based on the cutting data and controlling the pressing unit so that when the object is cut by moving the cutting blade and the holding member holding the object relative to each other, at least either an amount of pressing or a pressing force of the contact portion against the object is changed between a case where the region specified by the region specifying unit is cut and a case where any part of the object other than the specified region is cut.

DETAILED DESCRIPTION

First Embodiment

Figure 1:
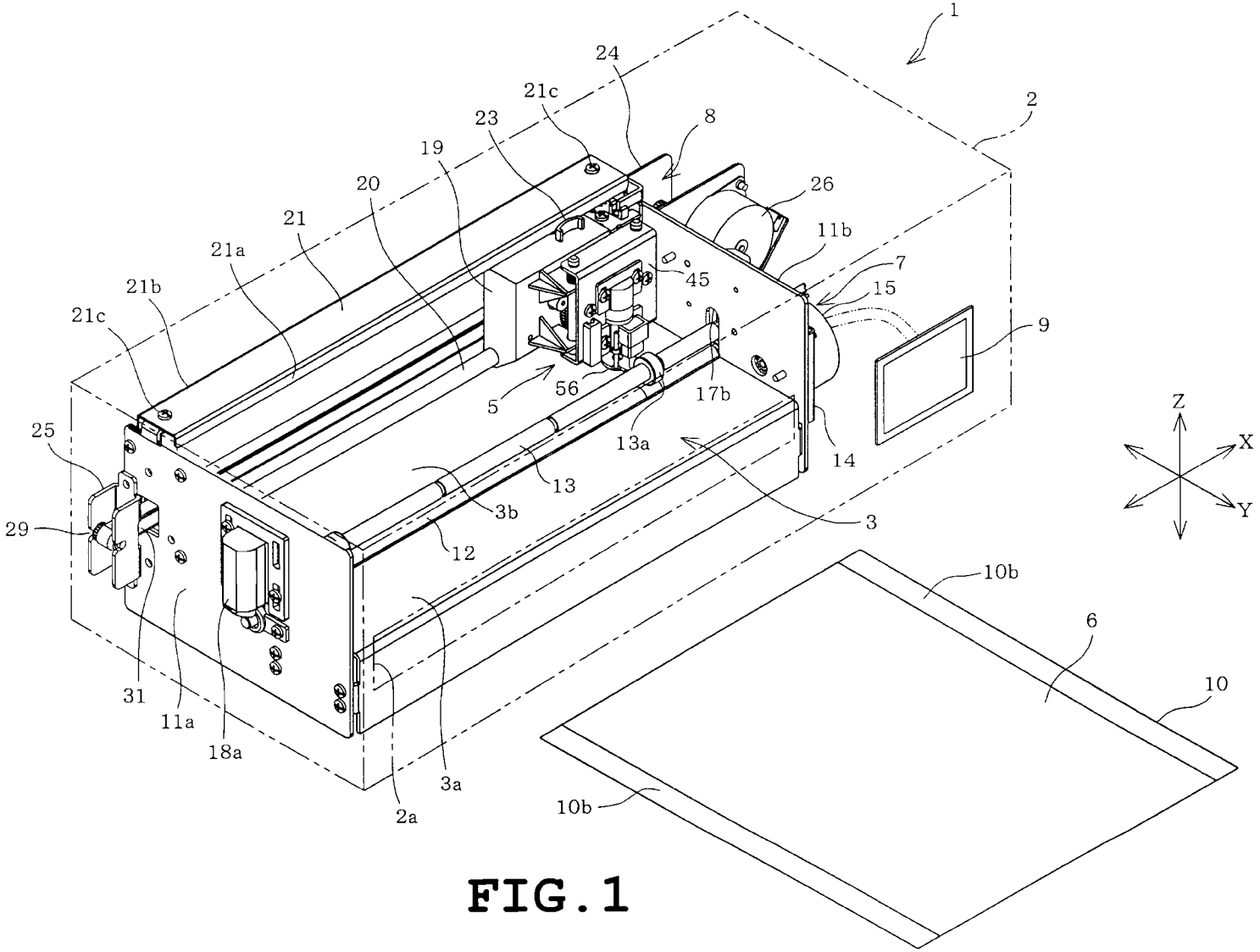
FIG. 1 is a perspective view of the cutting apparatus according to a first embodiment, showing an inner structure thereof.

A first embodiment will be described with reference to FIGS. 1 to 11. Referring to FIG. 1, a cutting apparatus 1 includes a body cover 2 as a housing, a platen 3 provided in the body cover 2 and a cutter holder 5 also provided in the body cover 2. The cutting apparatus 1 also includes first and second moving units 7 and 8 for moving a cutter 4 (see FIG. 5) of the cutter holder 5 and an object 6 to be cut, relative to each other. The body cover 2 is formed into the shape of a horizontally long rectangular box and has a front formed with a horizontally long opening 2*a* which is provided for setting a holding sheet 10 holding the object 6. In the following description, the side where the user who operates the cutting apparatus 1 stands will be referred to as "front" and the opposite side will be referred to as "back." The front-back direction thereof will be referred to as "Y direction." The right-left direction perpendicular to the Y direction will be referred to as "X direction."

On a right part of the body cover 2 is provided a liquid crystal display (LCD) 9 which serves as a display unit displaying messages and the like necessary for the user. A plurality of operation switches 65 (see FIG. 10) is also provided on the right part of the body cover 2. The platen 3 includes a pair of front and rear plate members 3*a* and 3*b* and has an upper surface which is configured into an X-Y plane serving as a horizontal plane. The platen 3 is set so that the holding sheet 10 holding the object 6 is placed thereon. The holding sheet 10 is received by the platen 3 when the object 6 is cut. The holding sheet 10 has an upper surface with an adhesive layer 10*a* (see FIG. 8) formed by applying an adhesive agent to a part thereof except for right and left edges 10*b*. The object 6 is affixed to the adhesive layer 10*a* thereby to be held.

Figure 2:
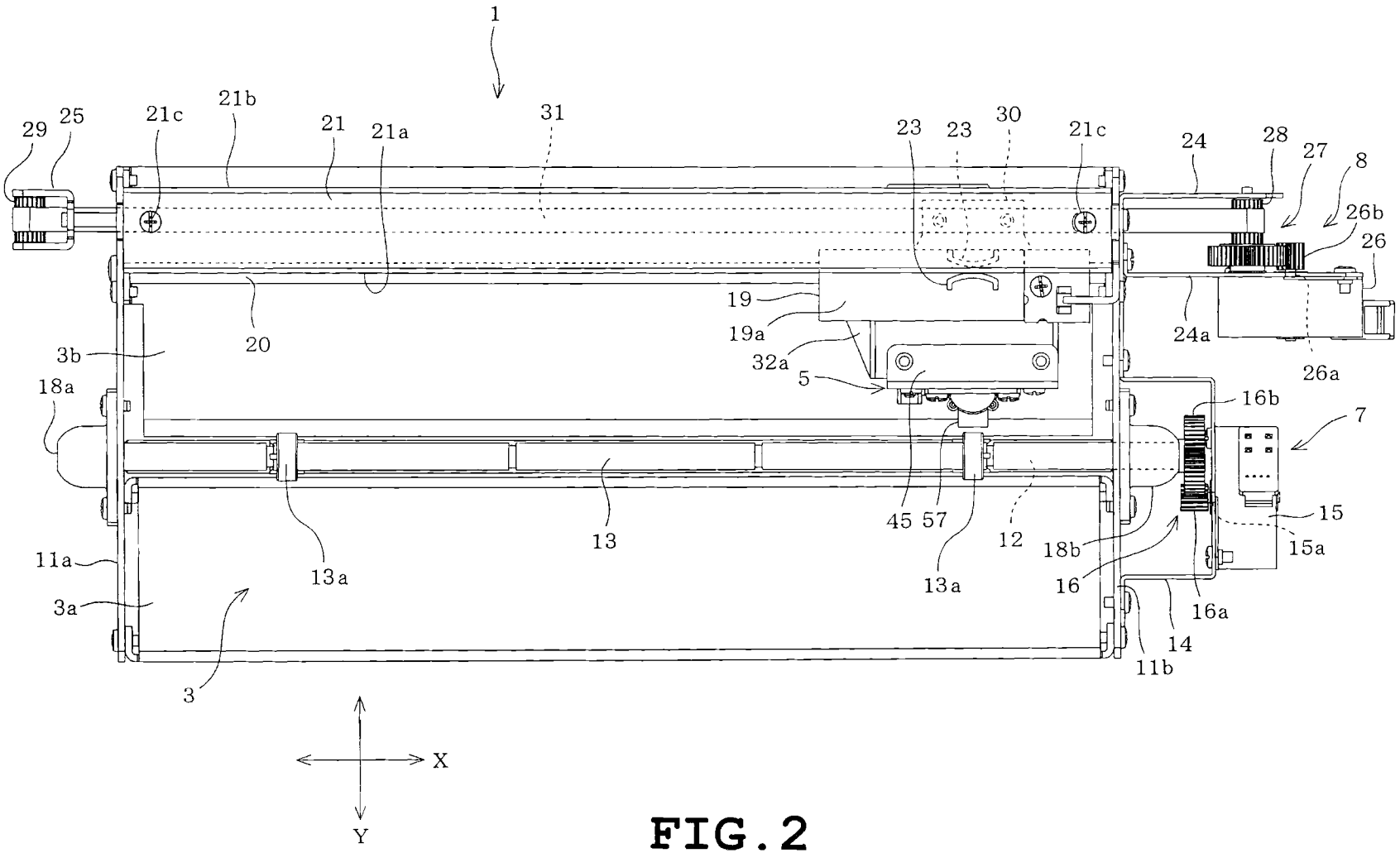
FIG. 2 is a plan view of the cutting apparatus.

The first moving unit 7 moves the holding sheet 10 on the upper surface side of the platen 3 in the Y direction (a first direction). More specifically, a driving roller 12 and a pinch roller 13 are provided on right and left sidewalls 11*b* and 11*a* so as to be located between plate members 3*a* and 3*b*. The driving roller 12 and the pinch roller 13 extend in the X direction and are rotatably supported on the sidewalls 11*b* and 11*a*. The driving roller 12 and the pinch roller 13 are disposed so as to be parallel to the X-Y plane and so as to be vertically arranged. The driving roller 12 is located lower than the pinch roller 13. A first crank-shaped mounting frame 14 is provided on the right sidewall 11*b* so as to be located on the right of the driving roller 12 as shown in FIG. 2. A Y-axis motor 15 is fixed to an outer surface of the mounting frame 14. The Y-axis motor 15 comprises a stepping motor, for example and has a rotating shaft 15*a* extending through the first mounting frame 14 and further has a distal end provided with a gear 16*a*. The driving roller 12 has a right end to which is secured another gear 16*b* which is brought into mesh engagement with the gear 16*a*. These gears 16*a* and 16*b* constitute a first reduction gear mechanism 16. The pinch roller 13 is guided by guide grooves 17*b* formed in the right and left sidewalls 11*b* and 11*a* so as to be movable upward and downward. Only the right guide groove 17*b* is shown in FIG. 1. Two spring accommodating members 18*a* and 18*b* are mounted on the right and left sidewalls 11*b* and 11*a* in order to cover the guide groove 17*b* from the outside respectively. The pinch roller 13 is biased downward by compression coil springs (not shown) accommodated in the spring accommodating portions 18*a* and 18*b* respectively. The pinch roller 13 is provided with pressing portions 13*a* which are brought into contact with a left edge 10*b* and a right edge 10*c* of the holding sheet 10, thereby pressing the edges 10*b* and 10*c*, respectively. Each pressing portion 13*a* has a slightly larger outer diameter than the other portion of the pinch roller 13.

The driving roller 12 and the pinch roller 13 press the holding sheet 10 from below and from above by the urging force of the compression coil springs thereby to hold the holding sheet 10 therebetween (see FIG. 11). Upon drive of the Y-axis motor 15, normal or reverse rotation of the Y-axis motor 15 is transmitted via the first reduction gear mechanism 16 to the driving roller 12, whereby the holding sheet 10 is moved backward or forward together with the object 6. The first moving unit 7 is thus constituted by the driving roller 12, the pinch roller 13, the Y-axis motor 15, the first reduction gear mechanism 16, the compression coil springs and the like.

The second moving unit 8 moves a carriage 19 supporting the cutter holder 5 in the X direction (a second direction). The second moving unit 8 will be described in more detail. A guide shaft 20 and a guide frame 21 both extending in the right-left direction are provided between the right and left sidewalls 11*b* and 11*a* so as to be located at the rear end of the cutting apparatus 1, as shown in FIGS. 1 and 2. The guide shaft 20 is disposed in parallel with the driving roller 12 and the pinch roller 13. The guide shaft 20 located right above the platen 3 extends through a lower part of the carriage 19 (a through hole 22 as will be described later). The guide frame 21 has a front edge 21*a* and a rear edge 21*b* both folded downward such that the guide frame 21 has a generally C-shaped section. The front edge 21*a* is disposed in parallel with the guide shaft 20. The guide frame 21 is adapted to guide an upper part (guided members 23 as will be described later) of the carriage 19 by the front edge 21*a*. The guide frame 21 is fixed to upper ends of the sidewalls 11*a* and 11*b* by screws 21*c* respectively.

A second mounting frame 24 is mounted on the right sidewall 11*b* in the rear of the cutting apparatus 1, and an auxiliary frame 25 is mounted on the left sidewall 11*a* in the rear of the cutting apparatus 1, as shown in FIG. 2. An X-axis motor 26 and a second reduction gear mechanism 27 are provided on the second mounting frame 24. The X-axis motor 26 comprises a stepping motor, for example and is fixed to a front of a front mounting piece 24*a*. The X-axis motor 26 includes a rotating shaft 26*a* which extends through the mounting piece 24*a* and has a distal end provided with a gear 26*b* which is brought into mesh engagement with the second reduction gear mechanism 27. A pulley 28 is rotatably mounted on the second reduction gear mechanism 27, and another pulley 29 is rotatably mounted on the left auxiliary frame 25 as viewed in FIG. 2. An endless timing belt 31 connected to a rear end (a mounting portion 30 as will be described later) of the carriage 19 extends between the pulleys 28 and 29.

Upon drive of the X-axis motor 26, normal or reverse rotation of the X-axis motor 26 is transmitted via the second reduction gear mechanism 27 and the pulley 28 to the timing belt 31, whereby the carriage 19 is moved leftward or rightward together with the cutter holder 5. Thus, the carriage 19 and the cutter holder 5 are moved in the X direction perpendicular to the Y direction in which the object 6 is conveyed. The second moving unit 8 is constituted by the above-described guide shaft 20, the guide frame 21, the X-axis motor 26, the second reduction gear mechanism 27, the pulleys 28 and 29, the timing belt 31, the carriage 19 and the like.

Figure 3:
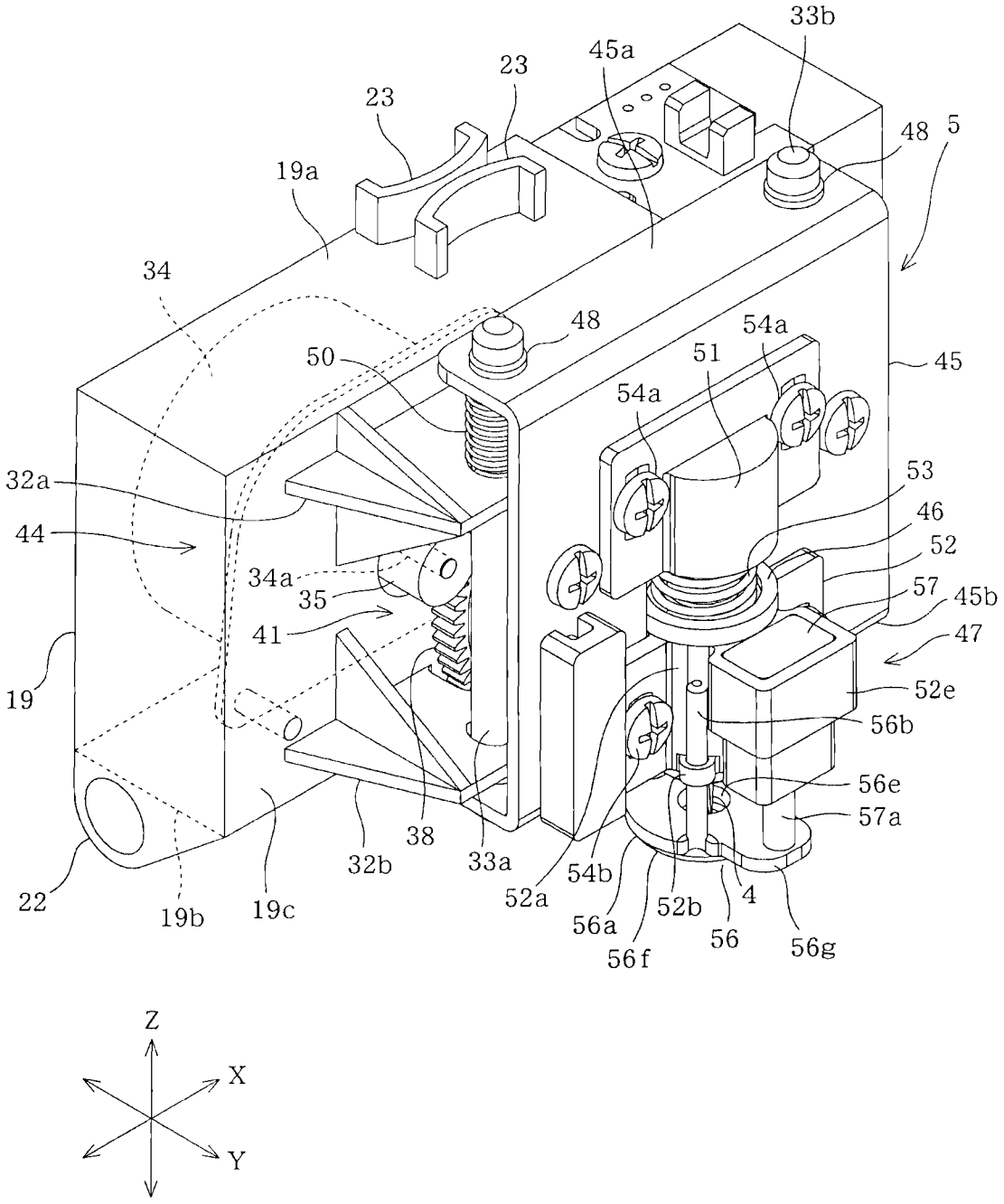
FIG. 3 is a perspective view of a cutter holder.
Figure 4:
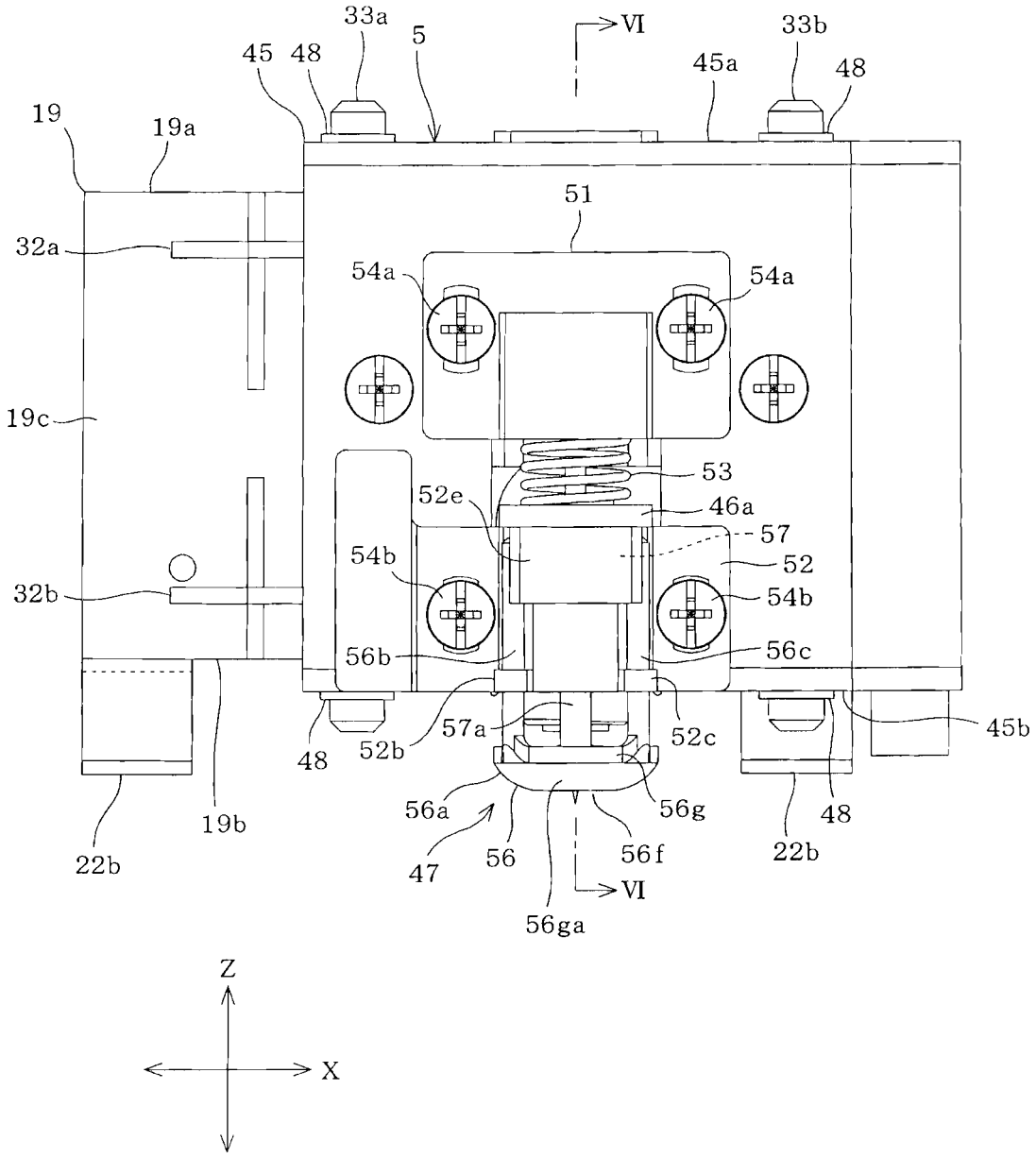
FIG. 4 is a front view of the cutter holder, showing the state where a cutter has been descended.
Figure 5:
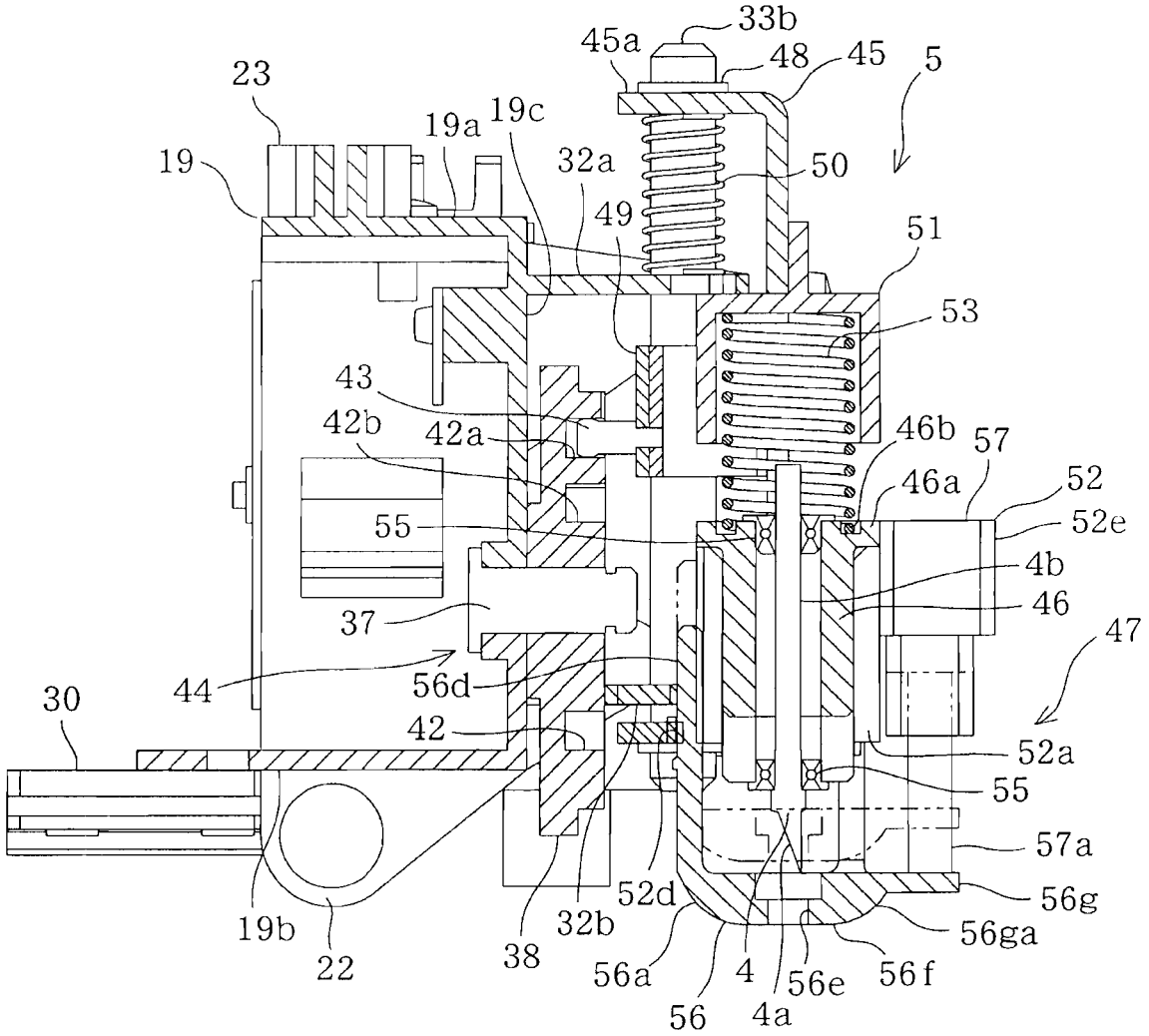
FIG. 5 is a sectional view of the cutter holder, showing the case where the cuter has been ascended.
Figure 6:
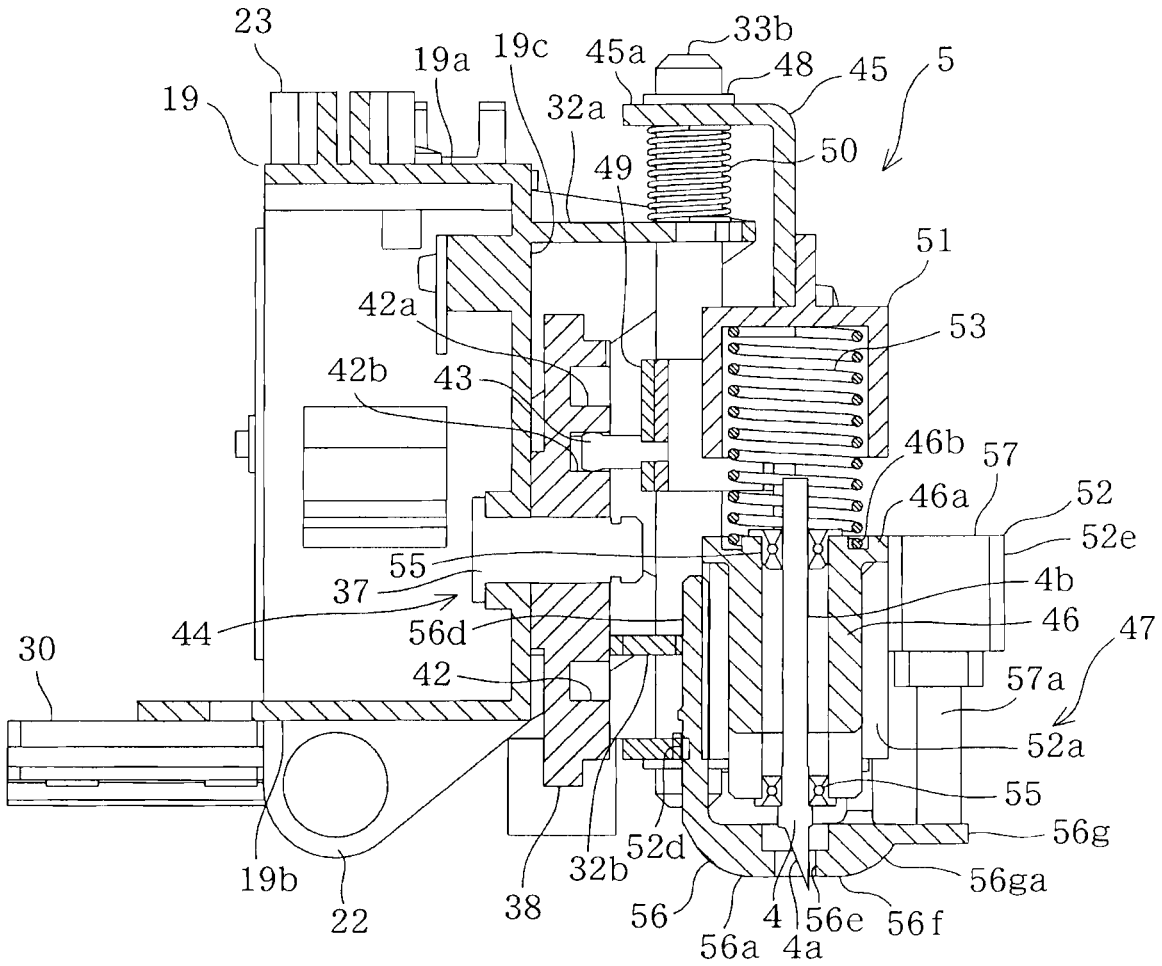
FIG. 6 is a sectional view taken along lines VI-VI in FIG. 4.

The cutter holder 5 is disposed on the front of the carriage 19 and is supported so as to be movable in a vertical direction (a third direction) serving as a Z direction. The carriage 19 and the cutter holder 5 will be described with reference to FIGS. 3 to 7 as well as FIGS. 1 and 2. The carriage 19 is formed into the shape of a substantially rectangular box with an open rear as shown in FIGS. 2 and 3. The carriage 19 has an upper wall 19*a* with which a pair of upwardly protruding front and rear guided members 23 are integrally formed. The guided members 23 are arc-shaped ribs as viewed in a planar view. The guided members 23 are symmetrically disposed with a front edge 21*a* of the guide frame 21 being interposed therebetween. The carriage 19 has a bottom wall 19*b* further having a downwardly expanding portion which is formed with a pair of right and left through holes 22 through which the guide shaft 20 is inserted, as shown in FIGS. 4, 5 and 6. An attaching portion 30 (see FIGS. 5 and 6) is mounted on the bottom wall 19*b* of the carriage 19 so as to protrude rearward. The attaching portion 30 is to be coupled with the timing belt 31. The carriage 19 is thus supported by the guide shaft 20 inserted through the holes 22 so as to be slidable in the right-left direction and further supported by the guide frame 21 held between the guided members 23 so as to be prevented from being rotated about the guide shaft 20.

Figure 11:
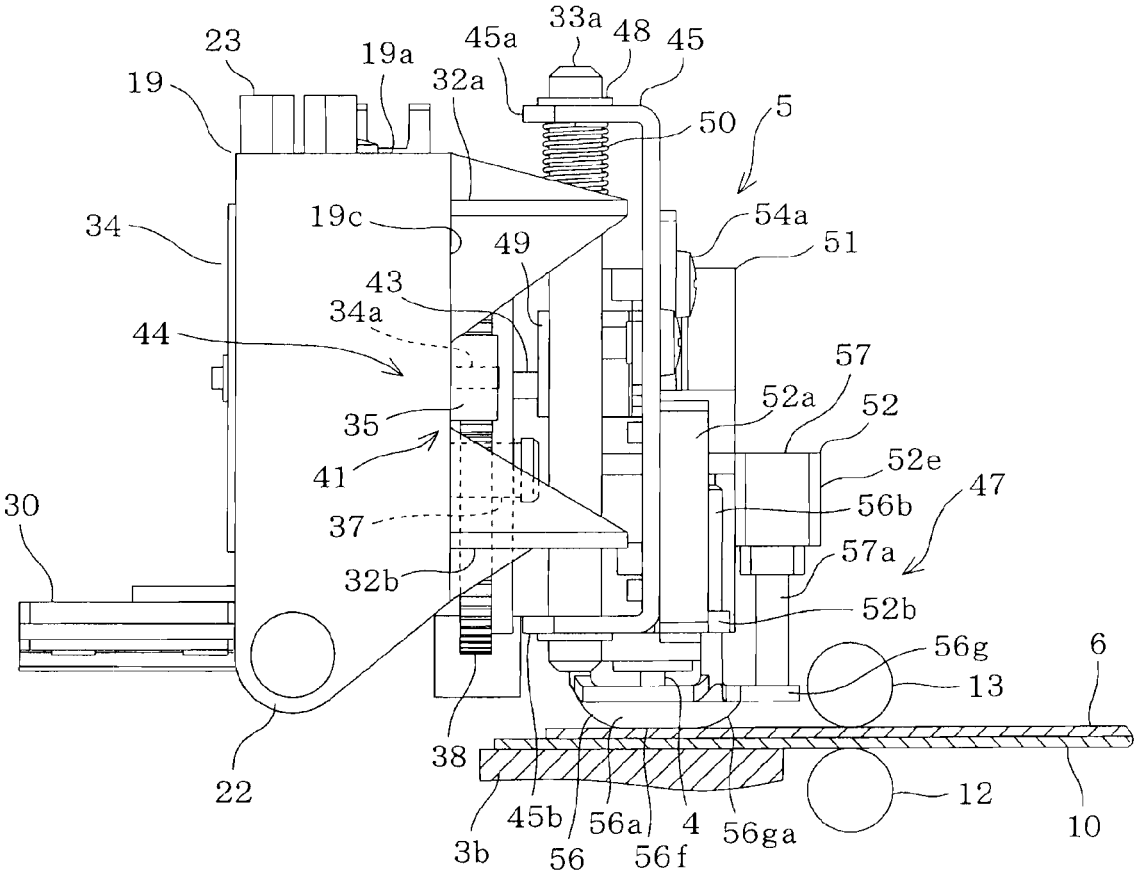
FIG. 11 is a side view of a cutter holder and the neighbor thereof during the cutting.

The carriage 19 has a front wall 19*c* with which a pair of upper and lower support portions 32*a* and 32*b* are formed so as to extend forward as shown in FIGS. 3 to 5, 11, etc. A pair of right and left support shafts 33*b* and 33*a* extending through the respective support portions 32*a* and 32*b* are mounted on the carriage 19 so as to be vertically movable. A Z-axis motor 34 comprising, for example, a stepping motor is accommodated in the carriage 19 backward thereby to be housed therein. The Z-axis motor 34 has a rotating shaft 34*a* (see FIGS. 3 and 11) which extends through the front wall 19*c* of the carriage 19. The rotating shaft 34*a* has a distal end provided with a gear 35. Furthermore, the carriage 19 is provided with a gear shaft 37 which extends through a slightly lower part of the gear 35 relative to the central part of the front wall 19*c* as shown in FIGS. 5, 6 and 11. A gear 38 is rotatably mounted on the gear shaft 37 and adapted to be brought into mesh engagement with the gear 35 in front of the front wall 19*c* is rotatably mounted on the gear shaft 37. The gear 38 is retained by a retaining ring (not shown) mounted on a front end of the gear shaft 37. The gears 35 and 38 constitute a third reduction mechanism 41 (see FIGS. 3 and 11).

Figure 7:
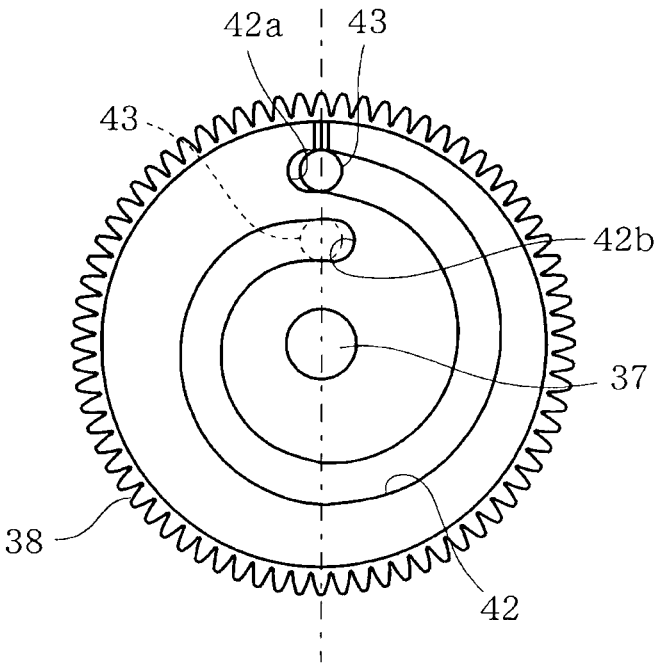
FIG. 7 is an enlarged front view of a gear.

The gear 38 is formed with a spiral groove 42 as shown in FIG. 7. The spiral groove 42 is a cam groove formed into a spiral shape such that the spiral groove 42 comes closer to the center of the gear 38 as it is turned rightward from a first end 42*a* toward a second end 42*b*. An engagement pin 43 which is vertically moved together with the cutter holder 5 engages the spiral groove 42 (see FIGS. 5 and 6) as will be described in detail later. Upon normal or reverse rotation of the Z-axis motor 34, the gear 38 is rotated via the gear 35. Rotation of the gear 38 vertically slides the engagement pin 43 in engagement with the spiral groove 42. With the vertical slide of the gear 38, the cutter holder 5 is moved upward or downward together with the support shafts 33*a* and 33*b*. In this case, the cutter holder 5 is moved between a raised position (see FIGS. 5 and 7) where the engagement pin 43 is located at the first end 42*a* of the spiral groove 42 and a lowered position (see FIGS. 6 and 7) where the engagement pin 43 is located at the second end 42*b*. A third moving unit 44 which moves the cutter holder 5 upward and downward is constituted by the above-described third reduction mechanism 41 having the spiral groove 42, the Z-axis motor 34, the engagement pin 43, the support portions 32*a* and 32*b*, the support shafts 33*a* and 33*b*, etc.

The cutter holder 5 includes a holder body 45 provided on the support shafts 33*a* and 33*b*, a movable cylindrical portion 46 which has a cutter 4 (a cutting blade) and is held by the holder body 45 so as to be vertically movable and a pressing device 47 which presses the object 6. More specifically, the holder body 45 has an upper end 45*a* and a lower end 45*b* both of which are folded rearward such that the holder body 45 is generally formed into a C-shape, as shown in FIGS. 3 to 5, 11 and the like. The upper and lower ends 45*a* and 45*b* are immovably fixed to the support shafts 33*a* and 33*b* by retaining rings 48 fixed to upper and lower ends of the support shafts 33*a* and 33*b*, respectively. The support shaft 33*b* has a middle part to which is secured a coupling member 49 provided with a rearwardly directed engagement pin 43 as shown in FIGS. 5 and 6. The holder body 45, support shafts 33*a* and 33*b*, the engagement pin 43 and the coupling member 40 are formed integrally with one another as shown in FIGS. 5 and 6. The cutter holder 5 is vertically moved by the third moving unit 44 in conjunction with the engagement pin 43. Furthermore, compression coil springs 50 serving as biasing members are mounted about the support shafts 33*a* and 33*b* so as to be located between upper surfaces of the support portion and upper end of the holder boy 45, respectively. The entire cutter holder 5 is elastically biased upward by a biasing force of the compression coil springs 50 relative to the carriage 19.

Mounting members 51 and 52 provided for mounting the movable cylindrical portion 46, the pressing device 47 and the like are fixed to the middle portion of the holder body 45 by screws 54*a* and 54*b* respectively, as shown in FIGS. 3 and 4. The lower mounting member 52 is provided with a cylindrical portion 52*a* (see FIG. 5) which supports the movable cylindrical portion 46 so that the movable cylindrical portion 46 is vertically movable. The movable cylindrical portion 46 has a diameter that is set so that the movable cylindrical portion 46 is brought into a sliding contact with the inner peripheral surface of the cylindrical portion 52*a*. The movable cylindrical portion 46 has an upper end on which a flange 46*a* supported on an upper end of the cylindrical portion 52*a* is formed so as to expand radially outward. A spring shoe 46*b* is provided on an upper end of the flange 46*a*. A compression coil spring 53 is interposed between the upper mounting member 51 and the spring shoe 46*b* of the movable cylindrical portion 46 as shown in FIGS. 5 and 6. The compression coil spring 53 biases the movable cylindrical portion 46 (the cutter 4) to the lower object 6 side while allowing the upward movement of the movable cylindrical portion 46 against the biasing force when an upward force acts on the cutter 4.

Figure 8:
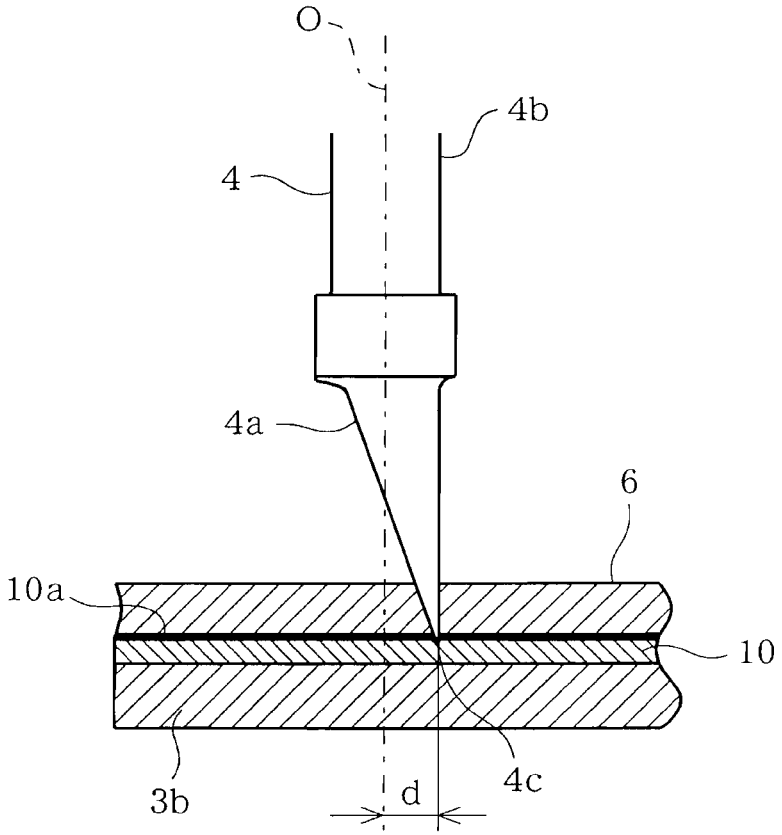
FIG. 8 is an enlarged view of the vicinity of a distal end of the cutter during the cutting.

The cutter 4 is provided in the movable cylindrical portion 46 so as to extend therethrough in the axial direction. In more detail, the cutter 4 has a round bar-like cutter shaft 4*b* which is longer than the movable cylindrical portion 46 and a blade 4*a* integrally formed on a lower end of the cutter shaft 4*b*. The blade 4*a* is formed into a substantially triangular shape and has a lowermost blade edge 4*c* formed at a location offset by a distance d from a central axis O of the cutter shaft 4*b*, as shown in FIG. 8. The cutter 4 is held by bearings 55 (see FIG. 5) mounted on upper and lower ends of the movable cylindrical portion 46 so as to be rotatably movable about the central axis O (the Z axis) in the vertical direction. Thus, the blade edge 4*c* of the cutter 4 presses an X-Y plane or the surface of the object 6 from the Z direction perpendicular to the X-Y plane. Furthermore, the cutter 4 has a height that is set so that when the cutter holder 5 has been moved to a lowered position, the blade edge 4*c* passes through the object 6 on the holding sheet 10 but does not reach the upper surface of the plate member 3*b* of the platen 3, as shown in FIG. 8. On the other hand, the blade edge 4*c* of the cutter 4 is moved upward with movement of the cutter holder 5 to the raised position, thereby being departed from the object 6 (see FIG. 5).

Three guide holes 52*b*, 52*c* and 52*d* (see FIGS. 3 to 5 and 11) are formed at regular intervals in a circumferential edge of the lower end of the cylindrical portion 52*a*. A pressing member 56 is disposed under the cylindrical portion 52*a* and has three guide bars 56*b*, 56*c* and 56*d* which are to be inserted into the guide holes 52*b* to 52*d* respectively. The pressing member 56 includes a lower part serving as a shallow bowl-shaped pressing portion body 56*a*. The aforementioned equally-spaced guide bars 56*b* to 56*d* are formed integrally on the circumferential end of the top of the pressing portion body 56*a*. The guide bars 56*b* to 56*d* are guided by the respective guide holes 52*b* to 52*d*, so that the pressing member 56 is vertically movable. The pressing portion body 56*a* has a central part formed with a through hole 56*e* which vertically extends to cause the blade 4*a* to pass therethrough. The pressing portion body 56*a* has an underside serving as a contact portion 56*f* which is brought into contact with the object 6 while the blade 4*a* is located in the hole 56*e*. The contact portion 56*f* is formed into an annular horizontal flat surface and is brought into surface contact with the object 6. The contact portion 56*f* is made of a fluorine resin such as Teflon® so as to have a lower coefficient of friction, whereupon the contact portion 56*f* is rendered slippery relative to the object 6.

The pressing portion body 56*a* has a guide 56*g* which is formed integrally on the circumferential edge thereof so as to extend forward, as shown in FIGS. 3 to 5 and 11. The guide 56*g* is located in front of and above the contact portion 56*f* and includes an inclined surface 56*ga* inclined rearwardly downward to the contact portion 56*f* side. Consequently, when the holding sheet 10 holding the object 6 is moved rearward relative to the cutter holder 5, the object 6 is guided downward by the guide 56*g* so as not to be caught by the contact portion 56*f*.

The mounting member 52 has a front mounting portion 52*e* for the solenoid 57, integrally formed therewith. The front mounting portion 52*e* is located in front of the cylindrical portion 52*a* and above the guide 56*g*. The solenoid 57 serves as an actuator for vertically moving the pressing member 56 thereby to press the object 6 and constitutes a pressing device 47 (a pressing unit) together with the pressing member 56 and a control circuit 61 which will be described later. The solenoid 57 is mounted on the front mounting portion 52*e* so as to be directed downward. The solenoid 57 includes a plunger 57*a* having a distal end fixed to the upper surface of the guide 56*g*. When the solenoid 57 is driven with the cutter holder 5 occupying the lowered position, the pressing member 56 is moved downward together with the plunger 57*a* thereby to press the object 6 with a predetermined pressure (see FIG. 11). On the other hand, when the plunger 57*a* is located above during non-drive of the solenoid 57, the pressing member releases the object 6 from application of the pressing force. When the cutter holder 5 is moved to the raised position during non-drive of the solenoid 57 (see two-dot chain line in FIG. 5), the pressing member 56 is completely departed from the object 6.

The holding sheet 10 has an adhesive layer 10*a* (see FIG. 8) which holds the object 6. The object 6 is immovably held on the holding sheet 10 by a resultant force of adhesion of the adhesive layer 10*a* and a pressing force of the pressing device 47. The configurations of the holding sheet 10 and the pressing device 47 will now be described with additional reference to FIGS. 8 and 9. The holding sheet 10 is made of, for example, a synthetic resin and formed into a flat rectangular plate shape, as shown in FIG. 1. The holding sheet 10 is placed opposite the cutter 4 and has a side (a side opposite the cutter 4) on which an adhesive layer 10*a* (see FIG. 8) is formed by applying an adhesive agent to the holding sheet 10. The sheet-like object 6 such as paper, cloth, resin film or the like is removably held by the adhesive layer 10*a*. The adhesive layer 10*a* has an adhesion that is set to a small value such that the object 6 can easily be removed from the adhesive layer 10*a* without breakage of the object 6.

When reference symbol $F_N$ designates a holding force necessary to hold the object 6 so that the object 6 is immovable relative to the holding sheet 10, the adhesive layer 10*a* is set at an adhesion $F_S$ that is smaller than $F_N$. More specifically, the adhesion $F_S$ is weaker than in the conventional structure in which the object is held only by the adhesion of the adhesive layer. The pressing force $F_P$ of the pressing device 47 by actuation of the solenoid 47 is set so that a resultant force of the pressing force $F_P$ and the adhesion $F_S$ of the adhesive layer 10*a* meets the necessary holding force $F_N$. The necessary holding force $F_N$ in this case is shown by the following equation (1):

$$F_N \leq F_S + F_P \tag{1}$$

In the cutting apparatus 1, the resultant force of the pressing force $F_P$ and the adhesion $F_S$ is thus set to be not less than the necessary holding force $F_N$ so that the object 6 is prevented from being displaced from the holding sheet 10 when the object 6 is cut by the cutter 4.

Figure 9:
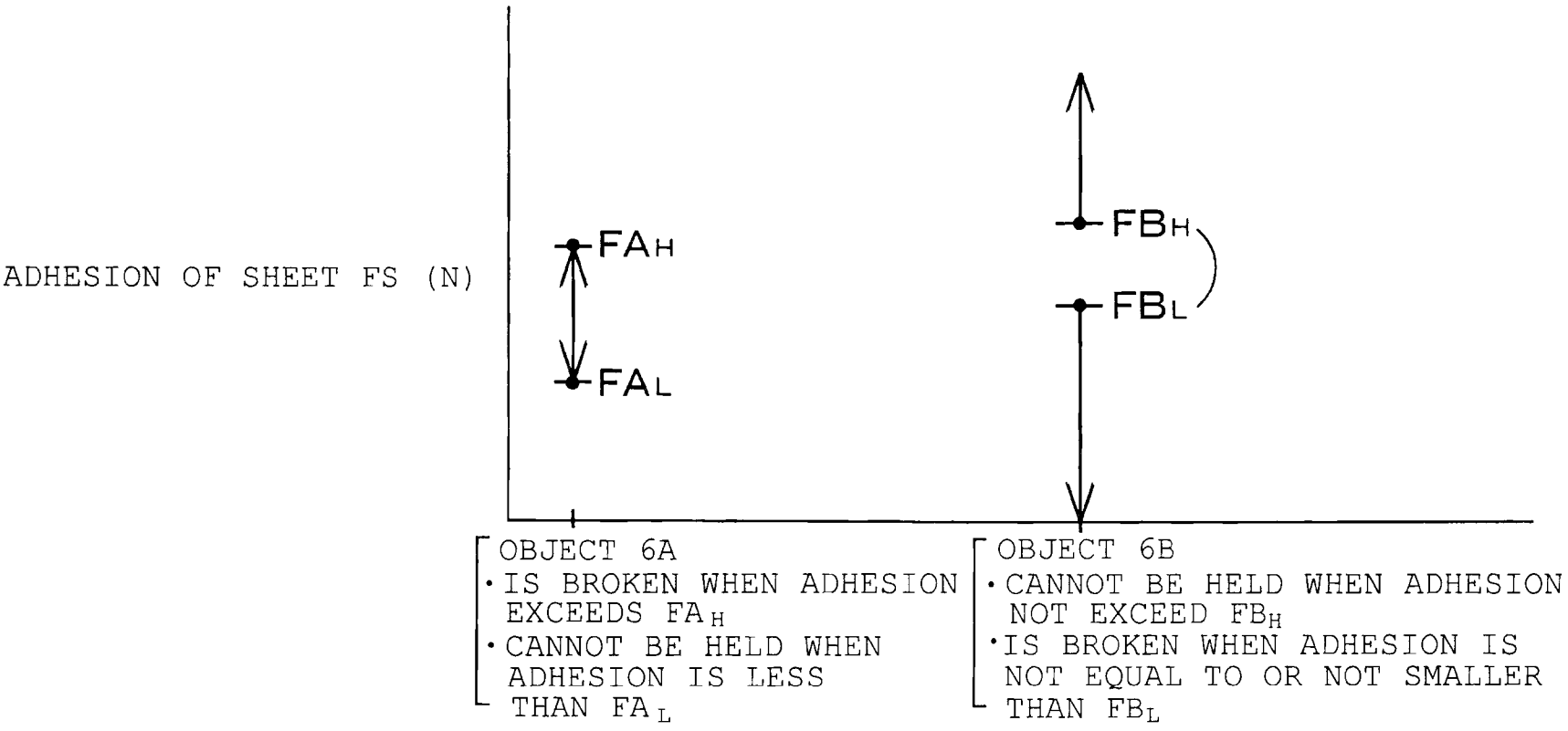
FIG. 9 is a schematic graph explaining the relationship between an adhesion of the holding member (an adhesive layer) and a type of the object.

FIG. 9 shows the relationship between the adhesion $F_S$ of the adhesive layer 10*a* and the objects 6A and 6B. In the case where the adhesion $F_S$ of the adhesive layer 10*a* exceeds $FA_H$, the object 6A is broken when removed from the adhesive layer 10*a*, and the object 6A cannot be held when the adhesion $F_S$ is less than $FA_L$. Accordingly, the adhesion $F_S$ can be ranged from $FA_H$ to $FA_L$. On the other hand, the object 6B cannot be held by the holding member 10 when the adhesion $F_S$ is not equal to or not larger than $FB_H$, and in the case where the object 6B is broken when the adhesion $F_S$ is larger than $FB_L$. Accordingly, the object is displaced from the holding sheet during the cutting in the conventional construction no matter how carefully the adhesion is adjusted, or the object 6B is broken when removed from the holding sheet. The conventional construction thus has the above-described problems.

In the embodiment, however, the pressing force $F_P$ of the pressing device 47 is set at the value corresponding to the difference ($FB_H$–$FB_L$) regarding the object 6B. In this case, even when $F_S$ is equal to $FB_L$, the object 6B can be held on the holding sheet 10 during cutting, and the object 6B can be prevented from breakage when removed from the holding sheet 10. Thus, the pressing force $F_P$ and the adhesion $F_S$ of the adhesive layer 10 are set according to the type, property of the object 6 or the like so that the object 6B on the holding sheet 10 can reliably be prevented from displacement during cutting and the object 6B can be prevented from breakage when removed from the holding sheet 10. The resultant force of the foregoing pressing force $F_P$ and the adhesion $F_S$ designates a single force which has an equal effect to these plural forces $F_P$ and the adhesion $F_S$.

Figure 10:
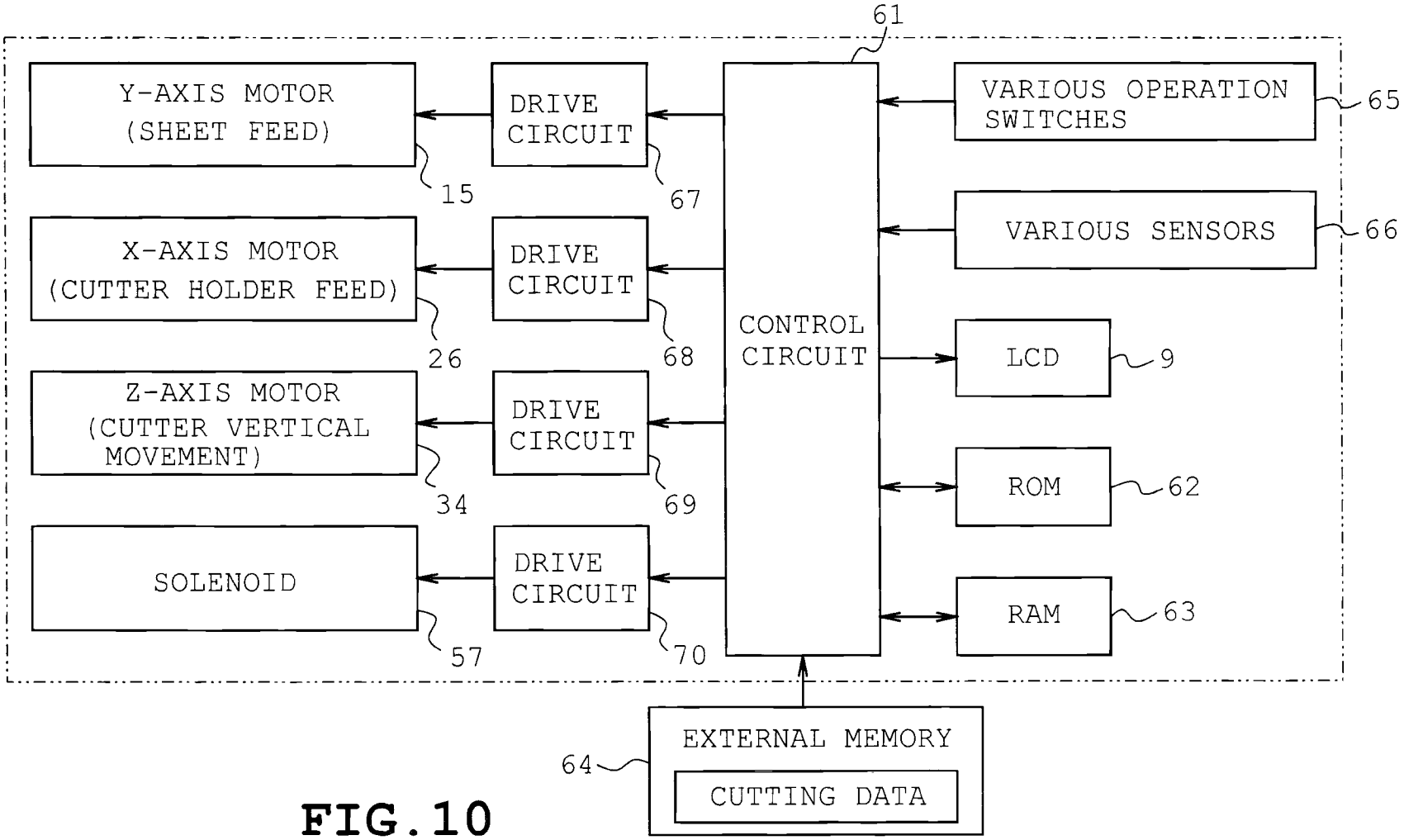
FIG. 10 is a block diagram showing an electrical arrangement of the cutting apparatus.

The arrangement of the control system of the cutting apparatus 1 will now be described with reference to a block diagram of FIG. 10. A control circuit (a control unit) 61 controlling the entire cutting apparatus 1 mainly comprises a computer (CPU) as shown in FIG. 10. A ROM 62, a RAM 63 and an external memory 64 each serving as a storage unit are connected to the control circuit 61. The ROM 62 stores a cutting control program for controlling the cutting operation, the threshold of a cutting angle and various control data and the like. The external memory 64 stores data of a plurality of cutting data and the like. The RAM 63 is provided with storage areas for temporarily storing various data and program necessary for execution of each processing.

Operation signals are supplied from the various operation switches 65 to the control circuit 61. The control circuit 61 controls a displaying operation of the LCD 9. In this case, while viewing the displayed contents of the LCD 9, the user operates the switches 65 to select and designate cutting data of a desired pattern. Detection signals are also supplied from various sensors 66 such as a sensor for detecting the holding sheet 10 set from the opening 2*a* of the cutting apparatus 1. To the control circuit 61 are connected drive circuits 67 to 70 driving the Y-axis, X-axis and Z-axis motors 15, 26 and 34 and the solenoid 57. Upon execution of the cutting control program, the control circuit 61 controls various actuators such as the Y-axis, X-axis and Z-axis motors 15, 26 and 34 and the solenoid 57, based on the cutting data, whereby the cutting operation is automatically executed for the object 6 on the holding sheet 10.

The control circuit 61 is configured as a control unit which controls the current supplied to the solenoid 57 to set the pressing force of the pressing device 47 at the aforesaid $F_P$. More specifically, the control circuit 61 controls the solenoid 57 to protrude the plunger 57*a* downward so that the pressing force FP is generated at the contact portion 56*f* of the pressing member 56 against the object 6. The pressing device 47 thus presses the object 6 against the contact surface of the object 6 in the Z direction perpendicular to the contact surface of the object 6, with which the contact portion 56*f* is brought into contact. The control to set the pressing force FP is adapted to be executed as a pressing force setting routine when the object 6 is cut by the cutter 4.

The operation of the cutting device 1 will be described. The cutter holder 5 occupies a raised position before the object 6 is cut, as shown in FIG. 5. In this state, the user affixes the object 6 to the adhesive layer 10*a* such that the object 6 is held by the holding sheet 10. The user then sets the holding sheet 10 to the cutting apparatus 1 from the opening 2*a* and operates the operation switches 65 to select, for example, a desired one of the cutting data stored in the external memory 64 so that a cutting operation is executed. Upon start of the cutting operation, the holding sheet 10 is firstly held between the driving roller 12 and the pinch roller 13 to be conveyed in the Y direction in order that the object 6 may be moved to a cut starting point. In this case, the object 6 is prevented from being caught by the contact portion 56*f* of the pressing member 56 even when the solenoid 57 is driven before the object 6 reaches the cut starting position. More specifically, the pressing member 56 is formed with a guide 56*g* having an inclined surface inclined toward and continuous to the contact portion 56*f*. Accordingly, the guide 56*g* prevents the object 6 from being caught by the contact portion 56*f* even when the set holding sheet 10 is moved rearward while the pressing member 56 occupies a position shown by solid line in FIG. 5.

When the object 6 has reached the cut starting point, the Z-axis motor 34 is driven to move the cutter holder 5 to the lowered position (see FIG. 11). The holding sheet 10 and the cutter 4 of the cutter holder 5 are moved relative to each other by the first and second moving units 7 and 8 on the basis of the cutting data respectively, whereby the object 6 is cut. The contact portion 56*f* applies the pressing force $F_P$ to the object 6 as the result of drive of the solenoid 57 during the cutting operation. Accordingly, the object 6 is held by both the adhesion $F_S$ of the adhesive layer 10*a* of the holding sheet 10 and the pressing force $F_P$ so as not to be displaced relative to the holding sheet 10. Furthermore, the pressing member 56 is moved relative to the object 6 during the cutting. However, since the contact portion 56*f* of the pressing member 56 is made of a material having a lower frictional coefficient than the object 6, a frictional force produced between the contact portion 56*f* and the object 6 can be reduced as much as possible. Consequently, the object 6 can be prevented from displacement due to the frictional force, whereupon the object can be held more reliably.

When the cutting of the object 6 has been finished, the user removes the object 6 from the holding sheet 10. In this case, since the adhesive layer 10*a* of the holding sheet 10 has the adhesion set at the value $F_S$, the object 6 can easily be removed from the holding sheet 10.

As described above, the pressing force $F_P$ is set at the value such that the resultant force of the adhesion $F_S$ of the adhesive layer 10*a* and the pressing force $F_P$ of the pressing device 47 meets the holding force $F_N$ necessary to immovably hold the object 6 relative to the holding sheet 10 when the object 6 is cut by the cutter 4.

Consequently, the object 6 can immovably be held on the holding sheet 10 by the resultant force of the adhesion $F_S$ of the adhesive layer 10*a* and the pressing force $F_P$ of the pressing device 47. Accordingly, the object 6, when cut, can reliably be prevented from displacement on the holding sheet 10, whereupon the object 6 can accurately be cut into a desired shape. Since the necessary holding force required of the holding sheet 10 can be compensated for by the pressing force FP of the pressing device 47, the adhesion $F_S$ of the adhesive layer 10*a* can be set to be weaker than in the conventional construction in which the object is held on the holding member only by the adhesion. Thus, the object 6 can easily be removed from the holding sheet 10 (the adhesive layer) without breaking the holding sheet after, for example, a sheet such as paper, serving as the object 6 has been cut.

The pressing device 47 includes the contact portion 56*f* which is brought into contact with the object 6 and made of the material with the lower frictional coefficient. The contact portion 56*f* can reduce the frictional force between the pressing member 56 and the object 6. Accordingly, the relative movement of the object 6 can smoothly be carried out while the object 6 is being pressed by the contact portion 56*f* of the pressing device 47.

The pressing device 47 is configured to press the object 6 in the direction perpendicular to the contact surface of the object 6 brought into contact with the contact portion 56*f*. Consequently, since the contact portion 56*f* can efficiently press the object 6, the object 6 can reliably be held.

The pressing device 47 includes the guide 56*g* which guides the object 6 to prevent the object 6 held by the holding sheet 10 from being caught by the contact portion 56*f*. The object 6 can be held so as not to displace on the holding sheet 10. Consequently, the object 6 can be cut more accurately.

Second Embodiment

Figure 12:
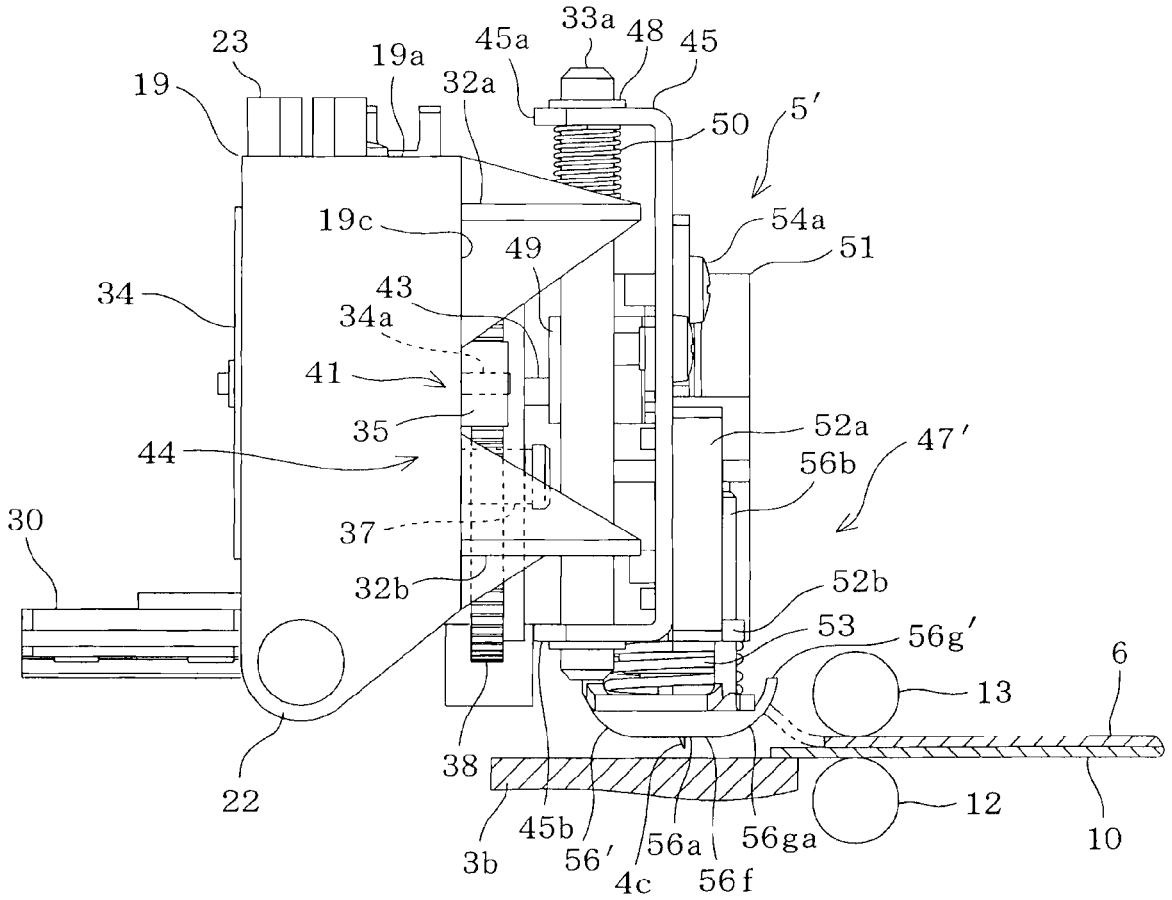
FIG. 12 is a view similar to FIG. 11, showing a second embodiment.

FIG. 12 illustrates a second embodiment. Only the difference between the first and second embodiments will be described. Identical or similar parts in the second embodiment are designated by the same reference symbols as those in the first embodiment. The cutter holder 5' in the second embodiment differs from the cutter holder 5 of the first embodiment in the following. The solenoid 57, the mount 52*e* and the like are eliminated in the cutter holder 5' and a compression coil spring 53 is disposed between the pressing member 56' and the movable cylinder 46. The pressing member 56' is held at a predetermined vertical position relative to the holder body 45. When the cutter holder 5' occupies the lowered position as shown in FIG. 12, the contact portion 56*f* of the pressing member 56 presses the object 6 with the aforementioned pressing force $F_P$. Thus, the pressing device 47' is constituted by the pressing member 56', the third moving unit 44, the control circuit 61, the compression coil spring 44 and the like. Consequently, the control to set the pressing force FP is executed by vertically moving the cutter holder 5 by the third moving unit 44.

Furthermore, the pressing member 56' has the guide 56*g'* formed integrally therewith. The guide 56*g'* extends obliquely upward in front of the contact portion 56*f*. The guide 56*g'* is formed into an arc shape and is continuous to the contact portion 56*f* so as to be inclined toward the contact portion 56*f*. As a result, as shown in FIG. 12, even if a part of the object 6 is turned upward from the holding sheet 10, the object 6 is guided by the guide 56*g'* so as not to be caught by the contact portion 56*f* in the same manner as the guide portion 56*g*.

In the second embodiment, the solenoid 57 and the like are eliminated and the pressing member 56' is held via the compression coil spring 53 at the predetermined position on the holder body 45, as described above. Thus, the pressing force $F_P$ applied to the object 6 can be obtained by the simple construction. Furthermore, the pressing force $F_P$ is suitably adjustable by changing the spring constant of the compression coil spring 53. Furthermore, the guide portion 56*g* can prevent the object 6 from being caught by the contact portion 56*f* or the vicinity thereof. The second embodiment can thus achieve substantially the same effect as the first embodiment.

Figure 17:
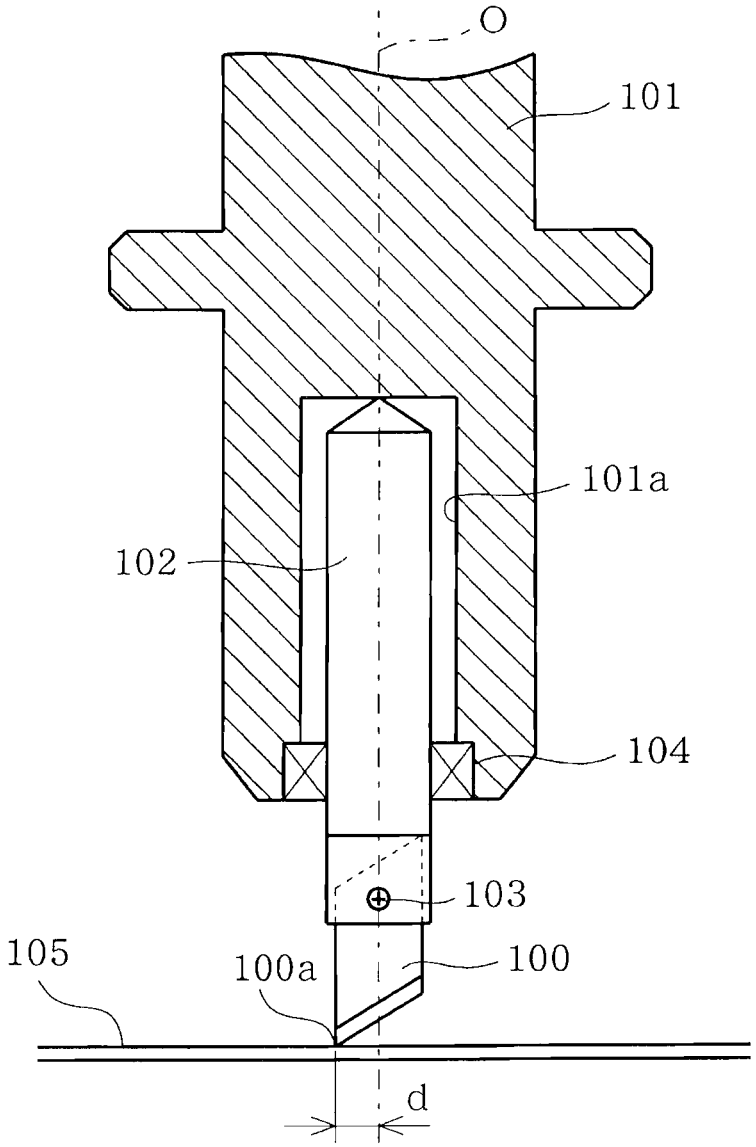
FIG.17 RELATED ART
FIG. 17 is an enlarged sectional view of a distal end of the cutter holder generally used with a conventional cutting plotter.

Meanwhile, since the conventional cutting apparatus is not provided with a pressing unit applying the pressing force $F_P$ to the object, there is a possibility that the object may displace from the sheet-like member during the cutting even when the sheet-like member has an adhesive layer. In particular, the cutter 100 as shown in FIG. 17 is rotatable about the axis O and accordingly, there is a possibility that corners of a cutting line of the sheet 105 as the object to be cut cannot be accurately cut. For example, when a cutting line is composed of first and second line segments which are formed into a V shape, the blade edge of the cutter 100 is directed to the direction of the first line segment at a cutting end point of the first line segment. Thereafter, the blade edge of the cutter 100 is changed to the direction of the second line segment when the cutting of the second line segment starts. As a result, even when the aforesaid sheet-like member is used, the corner where the direction of the blade edge of the cutter 100 is changed may cause burr during the cutting. This problem is more noticeable when an angle made between the first and second segments is acute or when the sheet 105 has a large thickness. Thus, it has been difficult to sufficiently hold the object so that the corners can be prevented from being burred in spite of the adhesion of the sheet-like member.

Figure 13A:
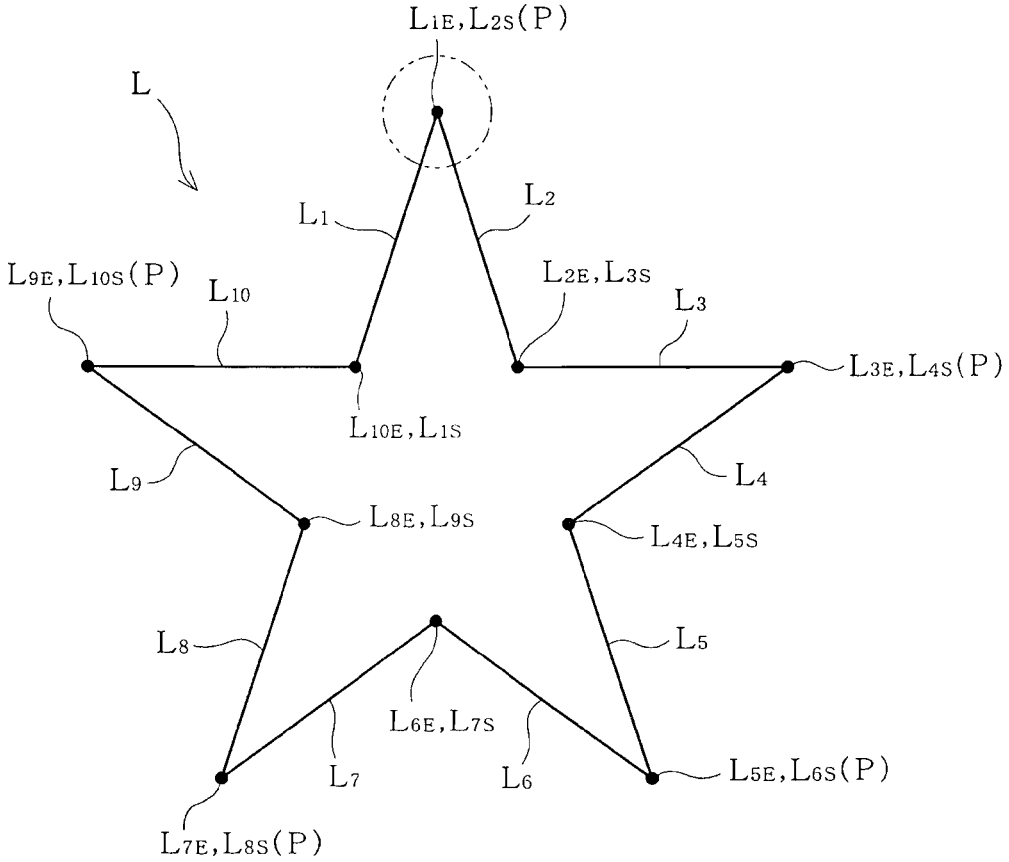
FIGS. 13A and 13B are a view of an example of cutting line of the object and an enlarged view of a partial corner of the cutting line in FIG. 13A, respectively.

In view of the above-described problem, the cutting apparatus of the following third embodiment specifies a region, such as the aforesaid corners, which is located along a cutting line of the object 6 and in which the adhesive holding force is relatively insufficient. The pressing force $F_P$ is changed between the case where the specified region is cut and the case where apart other than the specified region is cut, so that burr is reliably prevented from occurring at the corners. In the following description, a case where the pattern of a star is cut from the object 6 held by the holding sheet 10 as shown in FIG. 13A.

Third Embodiment

FIGS. 13A to 16 illustrate the third embodiment. Only the differences between the first and third embodiments will be described. The identical or similar parts in the third embodiment are labeled by the same reference symbols as those in the first embodiment.

Firstly, the cutting data includes line segment data corresponding to n number of line segments $L_1$ to $L_n$ composing the cutting line L. For example, when the pattern of a star is cut out of the object as shown in FIG. 13A, the cutting data has data of ten line segments comprising ten line segments $L_1$ to $L_n$ composing the cutting line L. More specifically, the line segments $L_1$ to $L_{10}$ have start points $L_{1S}$ to $L_{10S}$ and end points $L_{1E}$ to $L_{10E}$ respectively. The line segments $L_1$ to $L_{10}$ are continuous and constitute a closed single cutting line. Accordingly, start points of the line segments correspond with end points of the neighboring line segments respectively. The start and end points of the line segments $L_1$ to $L_{10}$ of the line segment data are shown by X-Y coordinates respectively. The X-Y coordinates have as an origin an apex located at the rear side in the Y-axis direction as a sheet feeding direction and at the start point side in the direction of the X-axis as a moving direction of the cutter 4.

The RAM 63 stores the cutting data including the above-mentioned data of n number of line segments read from the external memory 64. Consequently, when the object 6 is cut by the cutting apparatus 1, the line segments $L_1$ to $L_{10}$ are cut based on the cutting data stored in the RAM 63. In this case, in the cutting of the object 6 by the cutting apparatus 1, the holding sheet 10 (the object 6) is conveyed in the Y direction by the first moving unit 7 of the cutting apparatus 1 and the cutter holder 5 is moved in the X direction by the second moving unit 8, based on the cutting data, whereby the cutter 4 is moved to the X-Y coordinate of the start point $L_{1S}$ of the line segment $L_1$ relative to the holding sheet 10 with the object 6. Subsequently, the blade edge 4*c* of the cutter 4 is caused to pass through the start point $L_{1S}$ of the object 6 by the third moving unit 44. The holding sheet 10 with the object 6 and the cuter holder 5 with the cutter 4 are then moved by the first and second moving units 7 and 8 relative to each other respectively thereby to be moved toward the coordinate of the end point $L_{1E}$ of the line segment $L_1$, whereby the object 6 is cut along the line segment $L_1$. The subsequent line segment $L_2$ is continuously cut in the same manner as the line segment $L_1$ with the previous line segment $L_1$ serving as the start point $L_{2S}$. The cutting is also executed continuously in the cutting sequence of the line segment data with respect to each of the line segments $L_2$ to $L_{10}$, whereupon the cutting line L of the star pattern is cut.

Figure 13B:
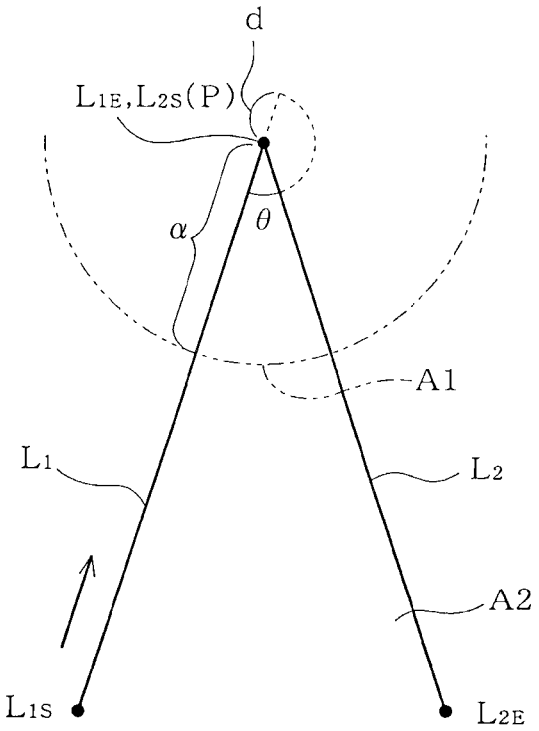

The threshold of the cutting angle stored in the ROM 62 is indicative of an angle θ made between neighboring line segments $L_1$ and $L_2$ as shown in FIG. 13B. The threshold T of the cutting angle is set at a predetermined value (130°, for example) and compared with the angle θ made between an (i−1)-th line segment $L_{i-1}$ to be cut and an i-th line segment $L_i$ to be cut. When the angle θ is not more than the threshold T, the control circuit 61 specifies a region around apex P as a region A1 where an adhesive retention of the adhesive layer 10*a* is insufficient along the cutting line L. The control circuit 61 thus constitutes a region specifying unit. The region A1 is specified on the basis of the threshold T. For example, the region A1 includes a part that is easily turned upward during cutting, such as an acute-angled corner made between the line segments $L_1$ and $L_2$ as shown in FIG. 13B, or a part including a corner that is easily drooped. The easily drooped corner refers to a slightly rounded distal end of a corner. In this case, for example, reference symbol "A1" designates a region in the range of a predetermined distance from the apex P of the corner and reference symbol "A2" designates a region other than the region A1. Accordingly, the region A2 includes a part other than the region A1 and an obtuse-angled portion where the cutting angle exceeds the predetermined value.

The blade edge 4*c* of the cutter 4 is offset from the central axis O of the cutter 4 by the distance d as described above (see FIG. 8), so that the blade edge 4*c* is subjected to a resistive force (hereinafter referred to as "cutting resistive force") from the object 6 with relative movement of the cutter 4 and the object 6. Accordingly, the cutter 4 is turned about the central axis O or in other words, with the relative movement of the cutter 4 and the object 6, the cutter 4 automatically changes its direction along the direction of the relative movement.

More specifically, cutting is firstly carried out along the line segment $L_1$ in the direction of arrow when the corner of the region A1 in the cutting line L of the star is cut, as shown in FIG. 13B. In this case, when the cutting blade 4*a* of the cutter 4 has reached the apex P (end point $L_{1E}$), the central axis O occupies a position located away by distance d from the apex P on an extended line from the line segment $L_1$. Since the blade edge 4*c* is subsequently changed to the direction along the line segment $L_2$, the cutter 4 is moved so that the central axis O is along the broken line (arc). Thereafter, the line segment $L_2$ is cut. In this case, the blade edge 4*c* passes through the object 6, biting slightly into the holding sheet 10, as shown in FIG. 8. Accordingly, a part corresponding to the apex P is slightly burred by the blade edge 4*c*. Furthermore, the part has a region which is in contact with the adhesive layer 10*a* and gradually becomes smaller and the adhesion retention of the adhesive layer 10*a* become weaker as it comes close to the distal end thereof. As a result, the corner of the region A1 is turned upward or burred. This problem is noticeable when the cutting angle θ is acute and/or the sheet is thick.

In view of the problem, the control circuit 61 in the embodiment is configured to control the current supplied to the solenoid 57 so that the pressing force of the pressing device 47 pressing the object 6 is changed or differentiated between a case where the region A1 is cut and a case where the region A2 other than the region A1 is cut. More specifically, in the case where the region A1 is cut, a resultant force of the adhesion $F_S$ of the adhesive layer 10*a* of the holding sheet 10 and the pressing force $F_{P1}$ is set to meet a holding force $F_{N1}$ necessary to hold the object 6 so that the corner of the region A1 is not turned over (or the corner is burred). The necessary holding force $F_{N1}$ in this case is shown by the following expression (2):

$$F_{N1} \leq F_S + F_{P1} \tag{2}$$

Furthermore, in the case where the region A2 is cut, a resultant force of the adhesion $F_S$ of the adhesive layer 10*a* of the holding sheet 10 and the pressing force $F_{P2}$ of the pressing device 47 is set to meet a holding force $F_{N2}$ necessary to hold the object 6 so that the object 6 is immovably held by the holding sheet 10 against the cutting resistance in the region A2. The necessary holding force $F_{N2}$ in this case is shown by the following expression (3):

$$F_{N2} \leq F_S + F_{P2} \tag{3}$$

In this case, since the pressing force $F_{P1}$ in the region A1 is set so as to be stronger or larger than the pressing force $F_{P2}$ in the region A2 ($F_{P1} > F_{P2}$), the corner can accurately be cut in the region A1 without causing the above-described problem. On the other hand, since the pressing force $F_{P2}$ in the region A2 is weaker than the pressing force $F_{P1}$, the load resulting from the relative movement of the cutter 4 and the object 6 can be reduced.

The control circuit 61 is configured as a control unit which controls the current supplied to the solenoid 57 to set the pressing force of the pressing device 47 at the aforementioned $F_{P1}$ or $F_{P2}$. More specifically, the control circuit 61 controls the solenoid 57 to be thrust downward so that the contact portion 56*f* of the pressing member 56 presses the object 6 with the pressing force $F_{P1}$ or $F_{P2}$. The contact portion 56*f* of the pressing device 47 thus presses the object 6 in the Z direction perpendicular to the contact surface of the object 6.

The control circuit 61 is also configured as a speed control unit which controls the rotational speeds of the Y-axis and X-axis motors 15 and 26 in association with the pressing forces $F_{P1}$ and $F_{P2}$ of the pressing device 47. More specifically, when the region A1 is to be cut, the control circuit 61 controls the motors 15 and 26 so that the relative moving speeds of the cutter 4 and the object 6 are the respective lower or first speeds. When the region A2 is to be cut, the control circuit 61 drives the motors 15 and 26 so that the relative moving speeds of the cutter 4 and the object 6 are the respective second speeds that are higher than the first speeds.

Figure 14:
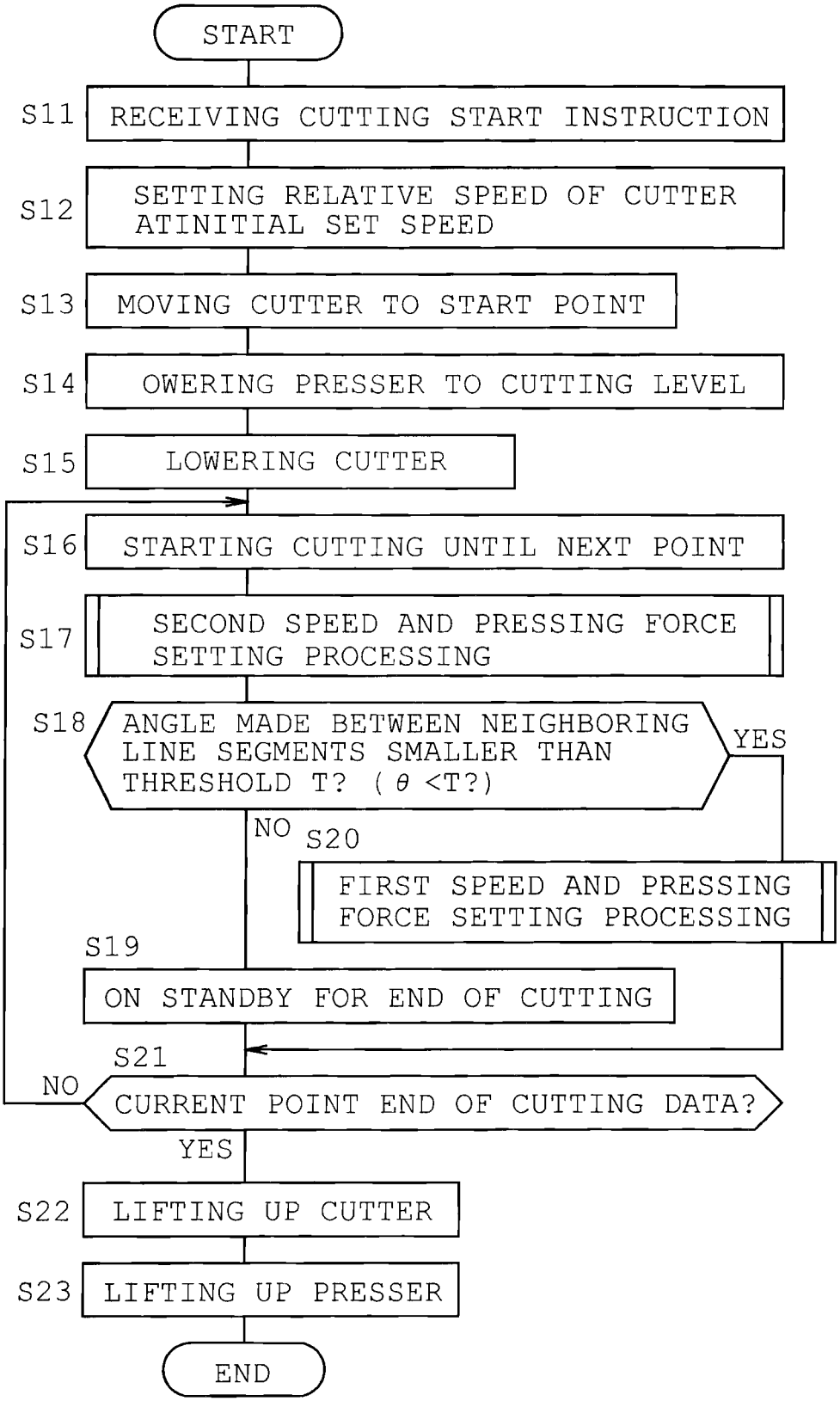
FIG. 14 is a flowchart showing an entire processing flow relating to depressing the object by a pressing unit.
Figure 15:
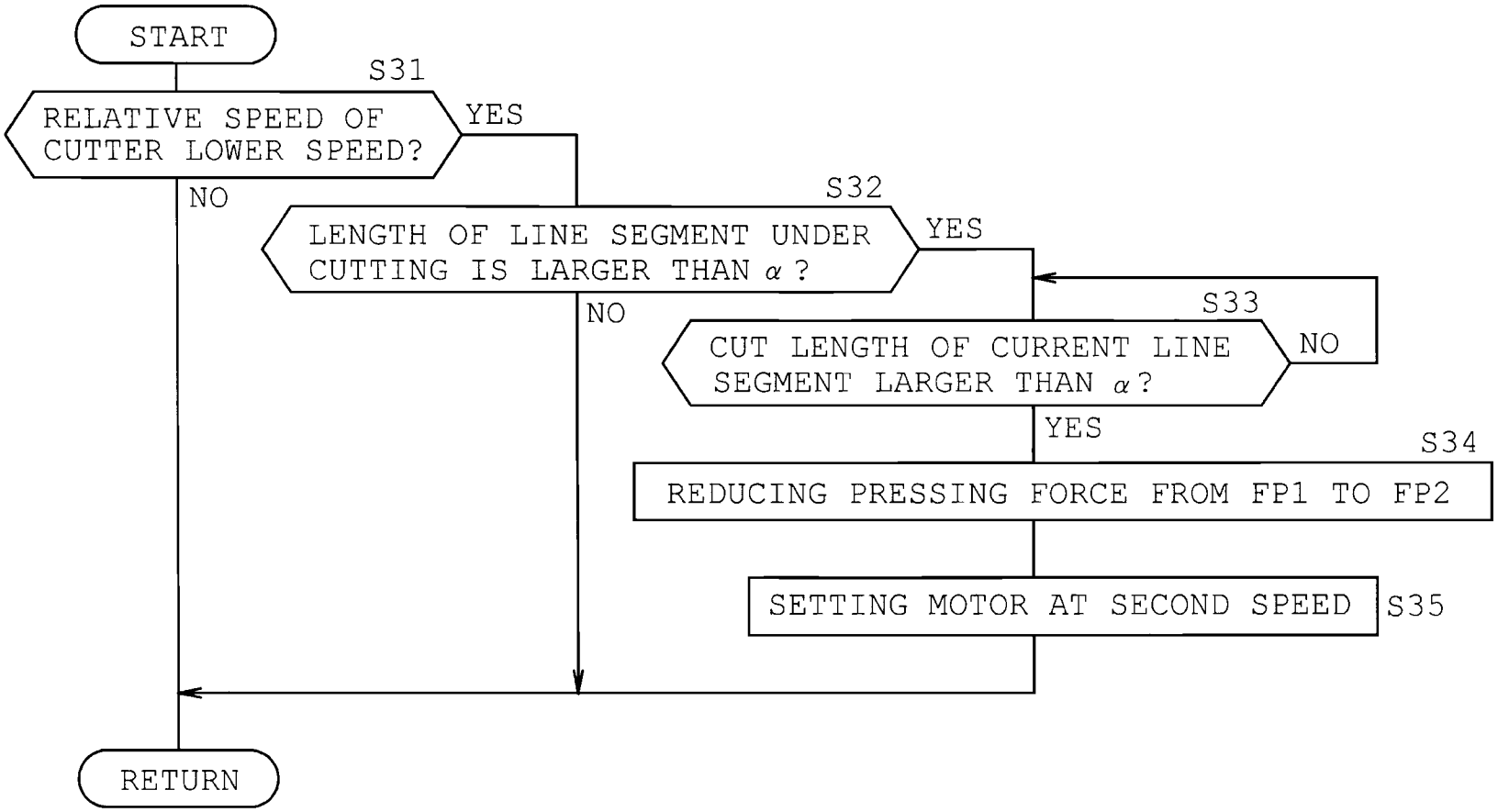
FIG. 15 is a flowchart showing a flow of second speed setting processing.
Figure 16:
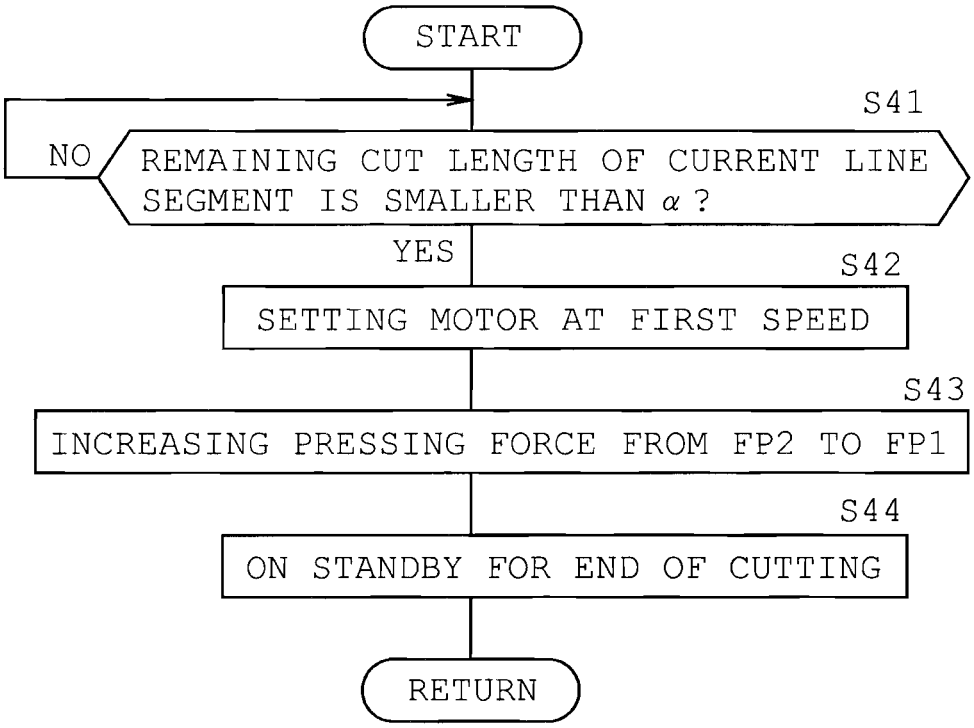
FIG. 16 is a flowchart showing a flow of first speed setting processing.

A concrete processing procedure of the cutting operation of the cutting apparatus 1 will now be described with reference to FIGS. 14 to 16, which are flowcharts showing processing flows of the cutting control program executed by the control circuit 61 respectively. In the figures, a symbol Si (where i=11, 12, 13 and . . . ) designates each step. The shape to be cut is the aforesaid "star" and ordinary paper is used as the object 6.

When the object 6 is to be cut by the cutting apparatus 1, the user sets the holding sheet 10 holding the object 6, from the opening 2*a* of the cutting apparatus 1 in the same manner as in the first embodiment. When the user has selected desired cutting data stored in the external memory, for example, the selected cutting data is stored in a memory of the RAM 63. Upon operation of the operation switches 65, the control circuit 61 starts the cutting operation based on the operation signal (step S11).

In the cutting operation, firstly, the moving speed of the cutter 4 relative to the object 6 is set at an initial set speed (the second speed (higher speed), for example) (step S12). Subsequently, the Y-axis and X-axis motors 15 and 26 are driven so that the blade edge 4*c* of the cutter 4 is moved to the cutting start point $L_{is}$ of the object 6 (see FIG. 13B). In this case, the cutter 4 is moved at a higher speed in the X-Y direction relative to the object 6 while being vertically located away from the object 6. When the cutter 4 has been moved to the cutting start point $L_{1S}$, the control circuit 61 drives the solenoid 57 so that the pressing member 56 presses the object 6 with a relatively weaker pressing force $F_{P2}$ (step S14). The control circuit 61 further drives the Z-axis motor 34 so that the cutter holder 5 is moved to the lowered position, whereby the blade edge 4*c* of the cutter 4 is caused to pass through the cutting start point $L_{1S}$ (step S15).

The motors 15 and 26 are driven to move the holding sheet 10 and the cutter 4 respectively so that the cutter 4 is moved to the coordinate (see FIG. 13B) of end point $L_{1E}$ of the line segment $L_1$, whereby the cutting of the line segment $L_1$ is started (S16). In this case, a second speed setting processing for the Y-axis and X-axis motors 15 and 26 is executed at step S17 (see FIG. 15). In the second speed setting processing, when the relative speed of the cutter 4 is set at the first speed (lower speed) (YES at step S31), the relative speed of the cutter 4 is changed to the second speed (higher speed). Since the relative speed of the cutter 4 has been set at the second speed (higher speed) by the initial setting (NO at step S31), the change to the second speed will be described later (the control circuit 61 returns to step S18 in FIG. 14).

The control circuit 61 computes the angle θ made by the line segment $L_1$ including the cutting start point $L_{1S}$ and the line segment $L_2$ to be subsequently cut, based on the line segment data of $L_2$. When the angle θ exceeds the threshold T (NO at step S18), the cutter 4 is moved to the endpoint $L_{1E}$ while the second speed is maintained (step S19). On the other hand, when the angle θ is not more than the threshold T, that is, when an acute corner such as apex P in FIG. 13B is to be cut (YES at step S18), a first speed setting processing is executed at step S20 (see FIG. 16).

In the first speed setting processing, it is determined whether or not a remaining length of the currently cut line segment $L_1$ is shorter than the distance a at step S41. In this case, the control circuit 61 is on standby for the remaining length being reduced below the distance a (when the cutter 4 reaches the region A1), the relative moving speed of the cutter 4 is changed from the second speed (higher speed) to the first speed (lower speed), whereupon the cut 4 is set at the lower speed (step S42). Simultaneously, the control circuit 61 controls a drive current of the solenoid 57 to change the pressing force of the pressing device 47 from $F_{P2}$ to $F_{P1}$ (step S43). As a result, the object 6 is pressed by the contact portion 56*f* of the pressing member 56 with the pressing force $F_{P1}$ in the region A1 (FIG. 13B) so that the object 6 is not turned upward. In this state, the cutter 4 is moved so that the blade edge 4*c* thereof reaches the apex P (end point $L_{1E}$ of $L_1$) (step S44). Thereafter, the control circuit 61 returns to step S21 in FIG. 14.

The control circuit 61 determines at step S21 whether or not the blade edge 4*c* of the cutter 4 is currently located at the endpoint $L_{10E}$ of the cutting line L, that is, whether or not the cutting of all the line segments $L_1$ to $L_{10}$ has ended. In this case, since the line segments $L_2$ to $L_{10}$ have not been cut (NO at step S21), the control circuit 61 starts the cutting of the line segment $L_2$ until the end point $L_{2E}$ is reached (step S16). The second speed setting processing is executed at step S17 (see FIG. 15).

In the second speed setting processing, the control circuit 61 determines at step S31 whether or not the moving speed of the cutter 4 relative to the object 6 is set at the first speed (lower speed). When determining that the moving speed of the cutter 4 relative to the object 6 is set at the first speed (YES at step S31) and that the line segment $L_2$ exceeds the distance a (YES at step S32), the control circuit 61 determines that the moving speed of the cutter 4 relative to the object 6 is set at the first speed (lower speed) in the cutting of the line segment $L_2$ and maintains the pressing force $F_{P1}$. More specifically, when the blade edge 4*c* has reached the apex P, the cutter 4 is changed to the direction of the line segment $L_2$, whereupon a clear acute cutting can be executed. Moreover, since the moving speed of the cutter 4 relative to the object 6 is set at the first speed (lower speed), a continuous stable cutting can be executed without step-out of the motors 15 and 26 in spite of strong pressing force $F_{P1}$. Thus, when having finished the cutting of the line segment $L_2$ by distance a (region $A_1$) (YES step A33), the control circuit 61 changes the pressing force of the pressing device 47 from $F_{P1}$ to $F_{P2}$ (step S34). The control circuit 61 further changes the moving speed of the cutter 4 relative to the object 6 from the first speed (lower speed) to the second speed (higher speed). More specifically, the control circuit 61 sets the relative moving speed of the cutter 4 to the second speed (higher speed) (step S35), returning to step S18 in FIG. 14. When determining at step S32 that the length of the line segment $L_2$ has not exceeded the distance a, the control circuit 61 maintains the pressing force $F_{P1}$ in the cutting of the line segment $L_2$ and the first speed (lower speed).

The control circuit 61 computes an angle θ made between the line segment $L_2$ and the line segment $L_3$ to be subsequently cut, based on line segment data of $L_3$. The control circuit 61 then compares an angle α obtained by computation with the threshold T, thereby executing the same cutting processing as the first line segment $L_1$ with respect to line segment $L_2$ or the first speed setting processing (steps S19 and S20). Steps S16 to S21 are thus repeated in the sequence of line segments $L_1$ to $L_{10}$, the cutting processing is executed with the suitable moving speed and the suitable pressing forces $F_{P1}$ and $F_{P2}$ for every regions A1 and A2 in each of the line segments $L_1$ to $L_{10}$. Furthermore, since the pressing force is increased at five corners as shown by "P" in FIG. 13A in the cutting processing, the object can be cut with clear acute lines. When determining that the cutting has been executed up to the end point L10E of the cutting line L of the "star" pattern (YES at step S21), the control circuit 61 moves the cutter holder 5 to the raised position (step S22), deactivates the solenoid 57 and moves the pressing member 56 upward (step S23), ending the processing.

Upon finishing the cutting of the object 6, the user removes the object 6 from the holding sheet 10. In this case, since the adhesion of the adhesive layer 10*a* of the holding sheet 10 is set at the aforesaid value $F_S$, the object 6 can easily be removed from the holding sheet 10. In the third embodiment, steps S17, S20, S34 and S43 serve as a pressing force setting routine of setting the pressing forces $F_{P1}$ and $F_{P2}$ of the pressing device 47. Steps S18, S32, S33 and S41 serve as a region specifying routine of specifying the region where the adhesive retention of the adhesive layer 10*a*. The control circuit 61 serves as a control unit and controls the pressing device 47 so that the pressing force of the contact portion 56*f* applied to the object 6 is differentiated or changed between a case where the region A1 specified by the region specifying routine is cut and a case where the region A2 other than the region A1 is cut.

According to the third embodiment, the object 6 can be held both by the adhesion of the adhesive layer 10*a* of the holding sheet 10 and by the pressing force of the pressing device 47. The region A1 where the adhesive retention is insufficient, such as the corners of the cutting line L, is specified by the region specifying routine. When the region A1 is to be cut, the pressing force applied to the object 6 is increased so that the pressing force is differentiated or changed from that in the cutting of the other region A2. As a result, the region A1 where the adhesive retention is insufficient is pressed by the contact portion 56*f* of the pressing device 47 thereby to be held so as not be turned upward, whereupon the region A1 can be accurately cut along the cutting line L.

The control circuit 61 serves as a speed control unit and executes the speed control routine of controlling the moving speeds of the cutter 4 and the object 6 relative to each other. The control circuit 61 is configured to differentiate or change the relative moving speed of the cutter 4 between the case where the region A1 is cut and the case where the region A2 other than the region A1 is cut. According to this configuration, the moving speed of the cutter 4 relative to the object 6 can be changed according to the pressing forces $F_{P1}$ and $F_{P2}$ pressing the object 6. Accordingly, when the load due to the movement of the cutter 4 relative to the object 6 is increased, the moving speed can be controlled so as to take a suitable value according to the load. Furthermore, when the load due to the movement of the cutter 4 relative to the object 6 is reduced, the relative moving speed of the cutter 4 is increased such that the cutting time can be reduced.

The control circuit 61 further serves as the region specifying unit and executes the region specifying routine of specifying the region A1 where the angle θ made by the neighboring line segments $L_{i-1}$ and $L_i$ is not more than the threshold T. According to this configuration, the region A1 including the corner of the cutting line L tends to be easily turned upward during the cutting and can be specified. Accordingly, since the specified region A1 is pressed by the contact portion 56*f* of the pressing device 47, the object 6 can be prevented from being turned upward, whereupon the object 6 can be cut clearly.

The foregoing embodiments are not restrictive but may be modified or expanded as follows. Although the cutting apparatus 1 is applied to the cutting plotter, the apparatus may be applied to various apparatuses with respective cutting functions. The pressing unit may be configured to move the pressing member upward and downward using another actuator such as an electric motor instead of the solenoid 57. Furthermore, the contact portion 56*f* may be made of a material having a low frictional coefficient except for fluorine resin such as Teflon. The surface of the contact portion 56*f* (the surface in contact with the object 6) may be coated with fluorine resin. Bright electroplating may be applied instead of the coating of fluorine resin.

The pressing device 47 may be controlled so that an amount of pressing the contact portion 56*f* applies to the object 6 is changed or differentiated between the case where the region A1 is cut and the case where the region A2 other than the region A1 is cut when the object 6 is cut. More specifically, when a relatively thicker sheet such as felt serving as the object 6 is cut, corners tend to be easily rounded. In view of the problem, the processing of increasing an amount of pressing the pressing member 56 applies to the region A1 is executed instead of the above-described step S43. In this case, since the pressing force of the solenoid 57 is improved, substantially the same processing as step S43 is executed. As a result, the height of the contact portion 56*f* can be adjusted so that the thickness of the sheet is suppressed. Accordingly, each corner can be cut so as to have a clear acute angle. In the case where an amount of pressing the contact portion 56*f* applies to the object 6 is controlled, the processing may be executed so that the height of the contact portion 56*f* is slightly increased when the region A2 is cut, instead of step S34.

Regarding the control unit in the first embodiment, the pressing force FP produced by drive of the solenoid 57 may be controlled so as to satisfy the expression (1). Also, regarding the control unit in the third embodiment, the pressing forces $F_{P1}$ and $F_{P2}$ may be controlled so as to satisfy the aforementioned expressions (2) and (3). More specifically, for example, the resultant force of the adhesion $F_S$ and the pressing force $F_{P1}$ may be set at the same value as the necessary holding force $F_{N1}$, and the resultant force of the adhesion $F_S$ and the pressing force $F_{P2}$ may be set at the same as the necessary holding force $F_{N2}$. Furthermore, the resultant force of the adhesion Fs and the pressing force $F_{P1}$ may be set at a value exceeding the necessary holding force FN1, and the resultant force of the adhesion $F_S$ and the pressing force $F_{P2}$ may be set at the same as the necessary holding force $F_{N2}$.

The storage medium storing the cutting control program should not be limited to the ROM 62 of the cutting apparatus 1. The storage medium may be CD-ROM, a flexible disc, DVD, external memory 64, instead. In this case, data stored in the storage medium is read into the computer serving as the control unit of the cutting apparatus 1 to be executed, whereupon the same work and effect as in the above-described embodiments can be achieved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting apparatus in which a cutting blade and an object to be cut are moved relative to each other based on cutting data, so that the object is cut by the cutting blade, the cutting apparatus comprising:

a holding member which is disposed at a position opposed to the cutting blade and has an adhesive layer removably holding the object;

a pressing unit which presses the object held by the holding member, the pressing unit having a contact portion which is brought into contact with the object; and a control unit which determines, in a cutting line of the object cut by the cutting blade based on the cutting data, whether an angle of a corner made by a first line segment and a second line segment adjacent to each other among a plurality of consecutive line segments constituting the cutting line is not more than a predetermined threshold, the first line segment having an end point positioned at an apex of the corner corresponding with a start point of the second line segment, wherein the control unit controls the pressing unit so that when the object is cut by moving the cutting blade and the holding member holding the object relative to each other, at least either an amount of pressing or a pressing force of the contact portion against the object is increased in a case of cutting a portion within a predetermined distance from the apex of the corner in each of the first and second line segments compared to a case of cutting other portions in the first and second line segments if it is determined that the angle of the corner made by the first line segment and the second line segment is not more than the threshold.

2. The cutting apparatus according to claim 1, wherein the control unit is further configured to control moving speeds of the cutting blade and the object relative to each other; and moving speeds of the cutting blade and the object relative to each other are made slower in a case of cutting a portion within the predetermined distance from the apex of the corner in each of the first and second line segments compared to a case of cutting other portions in the first and second line segments if it is determined that the angle of the corner made by the first line segment and the second line segment is not more than the threshold.

* * * * *